US007954935B2

(12) United States Patent
Kimura et al.

(10) Patent No.: US 7,954,935 B2
(45) **Date of Patent: *Jun. 7, 2011**

(54) LIQUID CONTAINER WITH MOUNTING AND REMOVAL GUIDE FOR REGULATING MOVEMENT OF THE LIQUID CONTAINER

(75) Inventors: Hitotoshi Kimura, Nagano-ken (JP); Taku Ishizawa, Nagano-ken (JP); Satoshi Shinada, Nagano-ken (JP); Takeo Seino, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 488 days.

This patent is subject to a terminal disclaimer.

(21) Appl. No.: 11/866,131

(22) Filed: Oct. 2, 2007

(65) Prior Publication Data

US 2008/0024572 A1 Jan. 31, 2008

Related U.S. Application Data

(63) Continuation of application No. 10/912,885, filed on Aug. 6, 2004, now Pat. No. 7,293,864.

(30) Foreign Application Priority Data

| | | |
|---|---|---|
| Aug. 8, 2003 | (JP) | 2003-290713 |
| Aug. 8, 2003 | (JP) | 2003-290728 |
| Jan. 30, 2004 | (JP) | 2004-023686 |
| Jun. 30, 2004 | (JP) | 2004-194203 |
| Jun. 30, 2004 | (JP) | 2004-194236 |

(51) Int. Cl.
*B41J 2/175* (2006.01)

(52) U.S. Cl. ..... 347/86

(58) Field of Classification Search ..... 347/85, 347/86, 37, 84, 87

See application file for complete search history.

(56) References Cited

U.S. PATENT DOCUMENTS 4,277,791 A 7/1981 Rosenstock et al.

(Continued)

FOREIGN PATENT DOCUMENTS

CN 1 349 894 5/2002

(Continued)

OTHER PUBLICATIONS

Office Action, dated Nov. 18, 2009, for German Application No. 10 2004 038 382.0-26.

(Continued)

*Primary Examiner* — An H Do

(74) *Attorney, Agent, or Firm* — Stroock & Stroock & Lavan LLP

(57) ABSTRACT

A liquid container includes a container body formed with a liquid supply port, and a container-side fixing structure which releasably regulates movement of the liquid container in an outward pulling direction in cooperation with apparatus-side fixing structure provided for the container mounting part in a state where the liquid container is mounted onto the container mounting part. The container-side fixing structure has a guide groove into which a fixing pin of the apparatus-side fixing structure can be inserted, and which guides the fixing pin in mounting and removal operations of the liquid container to and from the container mounting part. The guide groove includes a fixing part which engages the fixing pin to regulate the movement of the liquid container in the pulling direction in the state where the liquid container is mounted to the container mounting part. A slanted entrance surface is located at an entrance part of the guide groove, which slanted entrance surface slants so that a groove depth decreases in the movement direction of the fixing pin that relatively moves in association with an inserting operation of the liquid container into the container mounting part.

19 Claims, 17 Drawing Sheets

U.S. PATENT DOCUMENTS

| | | | | |
|---|---|---|---|---|
| 4,367,383 | A | 1/1983 | Sommansson | |
| 4,467,159 | A | 8/1984 | Ota et al. | |
| 4,661,667 | A | 4/1987 | Sorimachi et al. | |
| 5,211,431 | A | 5/1993 | Koizumi et al. | |
| 5,291,224 | A | 3/1994 | Asano et al. | |
| 5,500,664 | A | 3/1996 | Suzuki et al. | |
| 5,642,143 | A | 6/1997 | Rhoads | |
| 5,699,091 | A | 12/1997 | Bullock et al. | |
| 5,745,139 | A | 4/1998 | Sasaki | |
| 5,798,775 | A | 8/1998 | Takahashi et al. | |
| 5,805,187 | A | 9/1998 | Sasaki | |
| 5,841,453 | A | 11/1998 | Sasaki | |
| 5,949,459 | A | 9/1999 | Gasvoda et al. | |
| 6,070,975 | A | 6/2000 | Uchikata et al. | |
| 6,130,695 | A | 10/2000 | Childers et al. | |
| 6,250,750 | B1 | 6/2001 | Miyazawa et al. | |
| 6,264,314 | B1 | 7/2001 | Mochizuki et al. | |
| 6,276,789 | B1 | 8/2001 | Miyazaki et al. | |
| 6,281,912 | B1 | 8/2001 | Silverbrook | |
| 6,286,949 | B1 | 9/2001 | Lewis et al. | |
| 6,290,332 | B1 | 9/2001 | Crystal et al. | |
| 6,302,535 | B1 * | 10/2001 | Sturgeon et al. | 347/86 |
| 6,312,084 | B1 | 11/2001 | Ujita et al. | |
| 6,402,298 | B1 | 6/2002 | Nanjo et al. | |
| 6,431,681 | B2 | 8/2002 | Hatasa et al. | |
| 6,431,697 | B1 | 8/2002 | King et al. | |
| 6,454,381 | B1 | 9/2002 | Olsen et al. | |
| 6,460,982 | B1 | 10/2002 | Ito et al. | |
| 6,467,869 | B1 | 10/2002 | Merz et al. | |
| 6,471,333 | B1 | 10/2002 | Powell et al. | |
| 6,502,917 | B1 | 1/2003 | Shinada et al. | |
| 6,536,888 | B2 | 3/2003 | Trafton et al. | |
| 6,554,402 | B2 | 4/2003 | Trafton et al. | |
| 6,582,068 | B2 | 6/2003 | Ishizawa et al. | |
| 6,679,584 | B2 | 1/2004 | Silverbrook | |
| 6,722,762 | B2 | 4/2004 | Miyazawa et al. | |
| 6,742,872 | B2 | 6/2004 | Fukazawa et al. | |
| 6,749,292 | B2 | 6/2004 | Sturgeon et al. | |
| 6,755,514 | B2 | 6/2004 | Koga et al. | |
| 6,755,516 | B2 | 6/2004 | Hanson et al. | |
| 6,758,556 | B2 | 7/2004 | Ishizawa et al. | |
| 6,773,100 | B2 | 8/2004 | Kulpa et al. | |
| 6,773,280 | B2 | 8/2004 | Sasaki et al. | |
| 6,817,699 | B2 | 11/2004 | Hirashima et al. | |
| 6,832,830 | B2 | 12/2004 | Seino et al. | |
| 6,834,945 | B2 | 12/2004 | Ishizawa et al. | |
| 6,843,558 | B2 | 1/2005 | Seino | |
| 6,886,928 | B2 | 5/2005 | Sasaki et al. | |
| 7,018,027 | B2 | 3/2006 | Harada et al. | |
| 7,448,734 | B2 | 11/2008 | Silverbrook | |
| 7,566,106 | B2 | 7/2009 | Silverbrook | |
| 2002/0071011 | A1 | 6/2002 | Hayashi et al. | |
| 2002/0085075 | A1 | 7/2002 | Shinada et al. | |
| 2002/0109761 | A1 | 8/2002 | Shimizu et al. | |
| 2002/0196312 | A1 | 12/2002 | Ishizawa et al. | |
| 2004/0021737 | A1 | 2/2004 | Harada et al. | |
| 2004/0021738 | A1 | 2/2004 | Suganuma | |
| 2004/0212661 | A1 | 10/2004 | Tsuruma | |
| 2005/0036015 | A1 | 2/2005 | Seino et al. | |
| 2005/0052511 | A1 | 3/2005 | Seino et al. | |
| 2005/0116998 | A1 | 6/2005 | Harada | |
| 2005/0185036 | A1 | 8/2005 | Seino et al. | |
| 2005/0248637 | A1 | 11/2005 | Seino | |
| 2008/0284810 | A1 | 11/2008 | Nozawa et al. | |
| 2009/0262154 | A1 | 10/2009 | Silverbrook et al. | |

FOREIGN PATENT DOCUMENTS

| | | | |
|---|---|---|---|
| DE | 28 12 562 | A1 | 9/1979 |
| DE | 35 45 621 | A1 | 6/1986 |
| DE | 90 18 060.7 | | 8/1990 |
| DE | 103 27 251 | A1 | 2/2004 |
| DE | 299 24 675 | U1 | 9/2004 |
| EP | 0 412 459 | A2 | 2/1991 |
| EP | 0 496 642 | A2 | 7/1992 |
| EP | 0 829 363 | A2 | 3/1998 |
| EP | 0 997 297 | A1 | 5/2000 |
| EP | 1 000 749 | A2 | 5/2000 |
| EP | 1 122 076 | A1 | 8/2001 |
| EP | 1 177 904 | A1 | 2/2002 |
| EP | 1 199 179 | A1 | 4/2002 |
| EP | 1 213 148 | A1 | 6/2002 |
| EP | 1 247 651 | A2 | 10/2002 |
| EP | 1 323 533 | A2 | 7/2003 |
| EP | 1 354 709 | A1 | 10/2003 |
| EP | 1 375 159 | A1 | 1/2004 |
| EP | 1375159 | | 1/2004 |
| EP | 1457341 | A2 | 9/2004 |
| EP | 1504907 | A2 | 2/2005 |
| EP | 1 623 834 | A1 | 2/2006 |
| FR | 2 837 422 | | 9/2003 |
| GB | 1164260 | | 9/1969 |
| GB | 2 241 201 | A | 8/1991 |
| GB | 2 315 045 | A | 1/1998 |
| GB | 2 321 623 | A | 8/1998 |
| GB | 2 343 145 | A | 5/2000 |
| GB | 2 387 567 | A | 10/2003 |
| GB | 2 391 200 | A | 4/2004 |
| JP | 60-133071 | U | 9/1985 |
| JP | 61-059054 | U | 4/1986 |
| JP | 63-271676 | A | 11/1988 |
| JP | 1-141750 | A | 6/1989 |
| JP | 2-88248 | | 3/1990 |
| JP | 3-13628 | | 2/1991 |
| JP | 3-108557 | A | 5/1991 |
| JP | 03-193480 | | 8/1991 |
| JP | 3-197782 | A | 8/1991 |
| JP | 03-246039 | A | 11/1991 |
| JP | 4-247955 | A | 9/1992 |
| JP | 04-268686 | A | 9/1992 |
| JP | 4-119078 | U | 10/1992 |
| JP | 06-023757 | U | 3/1994 |
| JP | 06-064185 | A | 3/1994 |
| JP | 8-169121 | | 7/1996 |
| JP | 08-169121 | A | 7/1996 |
| JP | 09-011500 | | 1/1997 |
| JP | 09-123479 | | 5/1997 |
| JP | 09-167033 | A | 6/1997 |
| JP | 09-309213 | | 12/1997 |
| JP | 10-006611 | A | 1/1998 |
| JP | 10-109427 | | 4/1998 |
| JP | 10-235888 | | 9/1998 |
| JP | 2000-309107 | | 11/2000 |
| JP | 2001-058417 | | 3/2001 |
| JP | 2001-260373 | | 9/2001 |
| JP | 2001-267013 | | 9/2001 |
| JP | 2001-277541 | | 10/2001 |
| JP | 2001-341323 | | 11/2001 |
| JP | 2002-019135 | | 1/2002 |
| JP | 2002-019227 | A | 1/2002 |
| JP | 2002-31108 | | 1/2002 |
| JP | 2002-044828 | A | 2/2002 |
| JP | 2002-127546 | A | 5/2002 |
| JP | 2002-513340 | T | 5/2002 |
| JP | 2002-513341 | T | 5/2002 |
| JP | 2002-240260 | A | 8/2002 |
| JP | 2002-252046 | A | 9/2002 |
| JP | 2002-254673 | | 9/2002 |
| JP | 2002-273889 | A | 9/2002 |
| JP | 2002-313485 | A | 10/2002 |
| JP | 2003-19817 | | 1/2003 |
| JP | 2003-045562 | | 2/2003 |
| JP | 2003-175589 | | 6/2003 |
| JP | 2003-200590 | | 7/2003 |
| JP | 2003-341100 | A | 12/2003 |
| JP | 2004-66490 | A | 3/2004 |
| JP | 2004-74773 | A | 3/2004 |
| JP | 2005-096446 | | 4/2005 |
| WO | 98/55318 | A1 | 12/1998 |
| WO | 98/55324 | A1 | 12/1998 |
| WO | 99/59823 | | 11/1999 |
| WO | 01/49499 | A1 | 7/2001 |
| WO | 2004/098895 | A1 | 11/2004 |

OTHER PUBLICATIONS

Office Action for Japanese Patent Appln. No. 2003-168570, dated Jun. 9, 2009, and partial English translation thereof.

English language version of Office Action for Chinese Appln. 2007 10107316.0, Mar. 13, 2009.
Australian Patent Office—First Report on Patent Application No. 2004203638—Oct. 12, 2009.
European Patent Office—Office Action Pursuant to Article 96(2) EPC—Sep. 13, 2006.
European Search Report issued on Nov. 6, 2009 in corresponding European application, EP 07 80 7386.
Combined Search and Examination Report in United Kingdom Patent Appln. No. GB0417570.9, dated Nov. 23, 2004.
Combined Search and Examination Report in British appln. No. GB 0424553.6, dated Feb. 1, 2005.
Search Report, dated Jan. 20, 2006, from European patent appln. No. 04018763.5.
Combined Search and Examination Report in GB0520570.3 (Feb. 15, 2006).
Search Report from German Patent Appln. 10 2004 038 382.0-27, dated Mar. 22, 2006 (w/ Engl. translation).
Search Report from Chinese Patent Appln. 200410058408.0, dated May 26, 2006 (w/ Engl. translation).
Office Action, dated Aug. 25, 2009, for Japanese Application No. 2003-290713.
Office Action, dated Feb. 17, 2010 for Japanese Appln. No. 2004-194203 with partial translation.
Office Action, dated Feb. 17, 2010 for Japanese Appln. No. 2004-194236 with partial translation.
Office Action issued by the Mexican Patent Office (Instituto Mexicano de la Propiedad Industrial) on Mar. 26, 2010. A partial English translation is included in the attached letter from Mexican Patent Counsel.
Partial translation of an Office Action issued by the Japanese Patent Office on Apr. 6, 2010.
Office Action issued in U.S. Appl. No. 11/855,263 on Jun. 4, 2010.
Office Action issued on Dec. 1, 2010 in a counterpart Vietnamese Patent Application No. Jan. 1-2009-00728.
International Search Report and Written Opinion of PCT/JP2007/067982 issued on Sep. 14, 2007.

* cited by examiner

LIQUID CONTAINER WITH MOUNTING AND REMOVAL GUIDE FOR REGULATING MOVEMENT OF THE LIQUID CONTAINER

CROSS-REFERENCE TO RELATED APPLICATION

This application is a continuation of application Ser. No: 10/912,885, filed on Aug. 6, 2004, now U.S. Pat. No. 7,293,864 issued on Nov. 13, 2007.

BACKGROUND OF THE INVENTION

The present invention relates to a liquid container which stores liquid to be supplied to a liquid consuming apparatus therein, and is removably mountable to a container mounting part of the liquid consuming apparatus.

The liquid consuming apparatus includes, as a representative example thereof, a liquid ejecting apparatus, which ejects a liquid droplet from an ejection head. This liquid ejecting apparatus includes, as a representative example thereof, an ink jet type recording apparatus provided with an ink jet type recording head for recording an image. Other examples of the liquid ejecting apparatus include, for example, an apparatus having color material ejection head used in manufacture of a color filter of a liquid crystal display or the like, an apparatus having an electrode material (conductive paste) ejection head used in electrode formation of an organic EL display, a field emission display (FED) or the like, an apparatus having bioorganic matter ejection head used in biochip manufacture, and an apparatus having a sample ejection head as a precision pipette.

The ink jet type recording apparatus that is representative of the liquid jet apparatus is comparatively less noisy in printing, and can form fine dots with high density. Therefore, the ink jet type recording apparatus is presently used in various printing including color printing.

As a liquid supply system to the liquid consuming apparatus of which the ink jet type recording apparatus is representative, such a system is available, in which the liquid is supplied from a liquid container that stores the liquid therein to the liquid consuming apparatus. Further, in this liquid supply system using the liquid container, the liquid container is generally constituted as a cartridge removably mountable to the liquid consuming apparatus so that a user can exchange the liquid container easily when the liquid in the liquid container is consumed.

Generally, the ink jet type recording apparatus has a carriage that is equipped with a recording head for ejecting an ink droplet and reciprocates along a recording surface of a recording medium. As an ink supply system from the ink cartridge to the recording head, there is a system in which the ink cartridge is mounted on the carriage and the ink is supplied to the recording head from the ink cartridge reciprocating together with the recording head. Further, as another system, there is a system in which the ink cartridge is mounted onto a case or the like of an apparatus body and the ink is supplied through an ink flowing path formed by a flexible tube or the like from the ink cartridge to the recording head.

In any of the above ink supply systems, it is necessary to mount and fix the ink cartridge in a predetermined position of the apparatus body readily and surely. Further, in exchange of the ink cartridge, it is necessary to remove the ink cartridge from the apparatus body readily and surely.

Therefore, the conventional ink jet type recording apparatus and ink cartridge employ, as a mechanism for surely fixing the ink cartridge in the predetermined position of the apparatus body, for example, a mechanism in which the ink cartridge is pressed and fixed by a fixing lever operated after the ink cartridge is inserted into a cartridge holder of the apparatus body.

Patent Reference 1: WO99/59823
Patent Reference 2: JP2002-19135A
Patent Reference 3: JP2002-254673A However, such cartridge fixing mechanism requires separate steps performed independently, i.e. an insertion step of the ink cartridge into the cartridge holder and a fixing step by operating the fixing lever after insertion, so that the mounting operation of the ink cartridge to the apparatus body is complicated. Further, this conventional cartridge fixing mechanism also requires two-step operation when the ink cartridge is removed.

Further, such a mechanism is conceivable that realizes fixing of the ink cartridge simultaneously with the insertion step during mounting, but even this case requires a step of releasing the fixing when the ink cartridge is removed. This fixing release step must be performed completely independently of a subsequent operation of pulling out the ink cartridge. Therefore, the removing operation of the ink cartridge becomes complicated.

Further, in the conventional ink jet type recording apparatus and ink cartridge, there are those of such constitution that a memory element (IC) storing data such as the kind of ink and the residual ink amount is provided for the ink cartridge, and an apparatus-side contact to be connected to an IC side electrode is provided on the apparatus body side (for example, cartridge holder).

In a case that the ink cartridge having such IC is mounted onto the apparatus body, it is necessary to surely connect the IC-side electrode to the apparatus-side contact when the ink cartridge is mounted to the apparatus body, and further to surely maintain its connection state. Namely, it is necessary to suppress deviation between the apparatus-side contact and the IC-side electrode in a range enabling electric conduction. For example, it is conceivable to make the dimension of the IC-side electrode larger, to thereby make larger a permissible range of the deviation with respect to the apparatus-side contact. However, this results in a problem that the ink cartridge itself is also larger in size with size increase of the IC-side electrode.

Hence, in order to surely connect the IC-side electrode to the apparatus-side contact, the IC-side electrode of the ink cartridge must be positioned accurately with respect to the apparatus-side contact when the ink cartridge is mounted to the apparatus body. Further, in order to surely maintain the connection between the IC-side electrode of the ink cartridge and the apparatus-side contact, it is desirable that a force acts on the IC-side electrode of the ink cartridge to press the IC-side electrode against the apparatus-side contact.

The invention has been made in view of the above circumstances, and its object is to provide a liquid container, which can be mounted onto a liquid consuming apparatus readily and surely.

Another object of the invention is to provide a liquid container including a memory device having an electrode, which electrode can be surely connected to a contact of a liquid consuming apparatus when the liquid container is mounted onto the liquid consuming apparatus.

Yet another object of the invention is to provide a liquid container including a memory device having an electrode, which electrode can surely maintain connection to a contact of a liquid consuming apparatus.

SUMMARY OF THE INVENTION

The present invention provides a liquid container that can store therein liquid to be supplied to a liquid consuming apparatus, and which can be removably mounted onto a container mounting part of the liquid consuming apparatus. The liquid container includes: a container body formed with a liquid supply port through which the liquid to be supplied to the liquid consuming apparatus flows outward; and a container-side fixing structure which releasably regulates movement of the liquid container in an outward pulling direction in cooperation with apparatus-side fixing structure provided for the container mounting part in a state where the liquid container is mounted onto the container mounting part. The container-side fixing structure includes: a guide groove into which a fixing pin of the apparatus-side fixing structure can be inserted, and which guides the fixing pin in mounting and removal operations of the liquid container to and from the container mounting part; the guide groove including a fixing part which engages the fixing pin to regulate the movement of the liquid container in the pulling direction in the state where the liquid container is mounted to the container mounting part; and a slanted entrance surface located at an entrance part of the guide groove, which slanted entrance surface slants so that a groove depth decreases in the movement direction of the fixing pin that relatively moves in association with an inserting operation of the liquid container into the container mounting part.

The present invention further provides a liquid container that can store therein liquid to be supplied to a liquid consuming apparatus, and which can be removably mounted onto a container mounting part of the liquid consuming apparatus. The liquid container includes: a container body formed with a liquid supply port through which the liquid to be supplied to the liquid consuming apparatus flows outward; an electrode provided for the container body; and a container-side fixing structure which releasably regulates movement of the liquid container in an outward pulling direction in cooperation with apparatus-side fixing structure provided for the container mounting part in a state where the liquid container is mounted onto the container mounting part. The container-side fixing structure includes: a guide groove into which a fixing pin of the apparatus-side fixing structure can be inserted, and which guides the fixing pin in mounting and removal operations of the liquid container to the container mounting part. The electrode is located near the container-side fixing structure.

The present invention further provides a liquid container which can store therein liquid to be supplied to a liquid consuming apparatus, and which can be removably mounted onto a container mounting part of the liquid consuming apparatus. The liquid container includes: a container body formed with a liquid supply port through which the liquid to be supplied to the liquid consuming apparatus flows outward, the liquid supply port being disposed on a front wall of the container body in an insertion direction when the liquid container is mounted onto the container mounting part; an electrode provided for the container body, the electrode being connected to an apparatus-side contact provided in the container mounting part when the liquid container is mounted onto the container mounting part; a container-side abutment part abutting against an apparatus-side abutment part provided in the container mounting part when the liquid container is mounted onto the container mounting part, and receiving a pressing force from the apparatus-side abutment part in a direction opposite from the insertion direction of the liquid container; and a container fixing mechanism which holds the container body at a predetermined position in the container mounting part against a force acting on the container body from the container mounting part in the direction opposite from the insertion direction of the liquid container when the liquid container is mounted onto the container mounting part. The liquid supply port, the electrode, the container-side abutment part and the container fixing mechanism are arranged so that the pressing force applied to the container-side abutment part from the apparatus-side abutment part presses the electrode toward the apparatus-side contact when the liquid container is mounted onto the container mounting part.

The present invention further provides an ink cartridge including: a container body having a first wall, a second wall, a third wall, and a corner where the first wall, the second wall and the third wall meet together, the first wall at least in part lying on a first plane, the second wall at least in part lying on a second plane perpendicular to the first plane, and the third wall at least in part lying on a third plane perpendicular to both of the first and second planes; an ink supply port disposed on the first wall, the ink supply port having an axis perpendicular to the first plane; a guide groove disposed on the third wall proximate the corner, the guide groove having an entrance-side guide path leading from an entrance part to a fixing part, and an exit-side guide path distinct from the entrance-side guide path and leading from the fixing part to an exit part, the entrance part being open at the first wall; and an electrode disposed on the second wall proximate the corner, the electrode lying on a plane parallel to the second plane.

The present disclosure relates to the subject matter contained in Japanese patent application No. 2003-290713, (filed on Aug. 8, 2003), 2003-290728, (filed on Aug. 8, 2003), 2004-023686, (filed on Jan. 30, 2004), 2004-194203, (filed on Jun. 30, 2004) and 2004-194236, (filed on Jun. 30, 2004), each of which is expressly incorporated herein by reference in its entirety.

BRIEF DESCRIPTION OF THE DRAWINGS

FIGS. 2A to 2D are diagrams showing the ink cartridge according to the embodiment of the invention, in which FIG. 2A is a plan view, FIG. 2B is a side view, FIG. 2C is a rear view, and FIG. 2D is a front view.

FIGS. 3A and 3B are diagrams showing the ink cartridge according to the embodiment of the invention, in which FIG. 3A is a bottom view, and FIG. 3B is a side view.

FIGS. 4A to 4D are perspective views showing the ink cartridge according to the embodiment of the invention, in which FIG. 4A is a diagram viewed in a direction where a diagonally upward back surface can be seen, FIG. 4B is a diagram viewed in a direction where a diagonally downward front surface can be seen, FIG. 4C is a diagram viewed in a direction where a diagonally downward back surface can be seen, and FIG. 4D is a diagram viewed in a direction where a diagonally upward front surface can be seen.

FIGS. 6A to 6D are diagrams showing a state in which a lid member is removed from the ink cartridge according to the embodiment of the invention, in which FIG. 6A is a plan view in a state where an ink bag is housed, FIG. 6B is a front view of FIG. 6A, FIG. 6C is a plan view in a state where the ink bag is not housed, and FIG. 6D is a front view of FIG. 6C.

FIGS. 14A and 14B are enlarged perspective views of a turn lever member of the cartridge mounting part shown in FIGS. 12 and 13, in which FIG. 14A is a diagram viewed from a diagonal upside, and FIG. 14B is a diagram viewed from a diagonal downside.

FIGS. 15A and 15B are enlarged views of the ink cartridge according to the embodiment of the invention, in which FIG. 15A is a bottom plan view showing a rear surface of a front-end part, and FIG. 15B is a front elevational view showing a front surface.

FIGS. 16A to 16C are diagrams illustrating the depth and shape of a guide groove of the ink cartridge according to the embodiment of the invention, in which FIG. 16A is a bottom plan view of the ink cartridge, FIG. 16B is a cross-sectional view taken along a line b-b in FIG. 16A, and FIG. 16C is a sectional view taken along a line c-c in FIG. 16A.

DESCRIPTION OF THE PREFERRED EMBODIMENT

As an embodiment of a liquid container according to the invention, an ink cartridge for an ink jet type recording apparatus will be described with reference to drawings.

Figure 1:
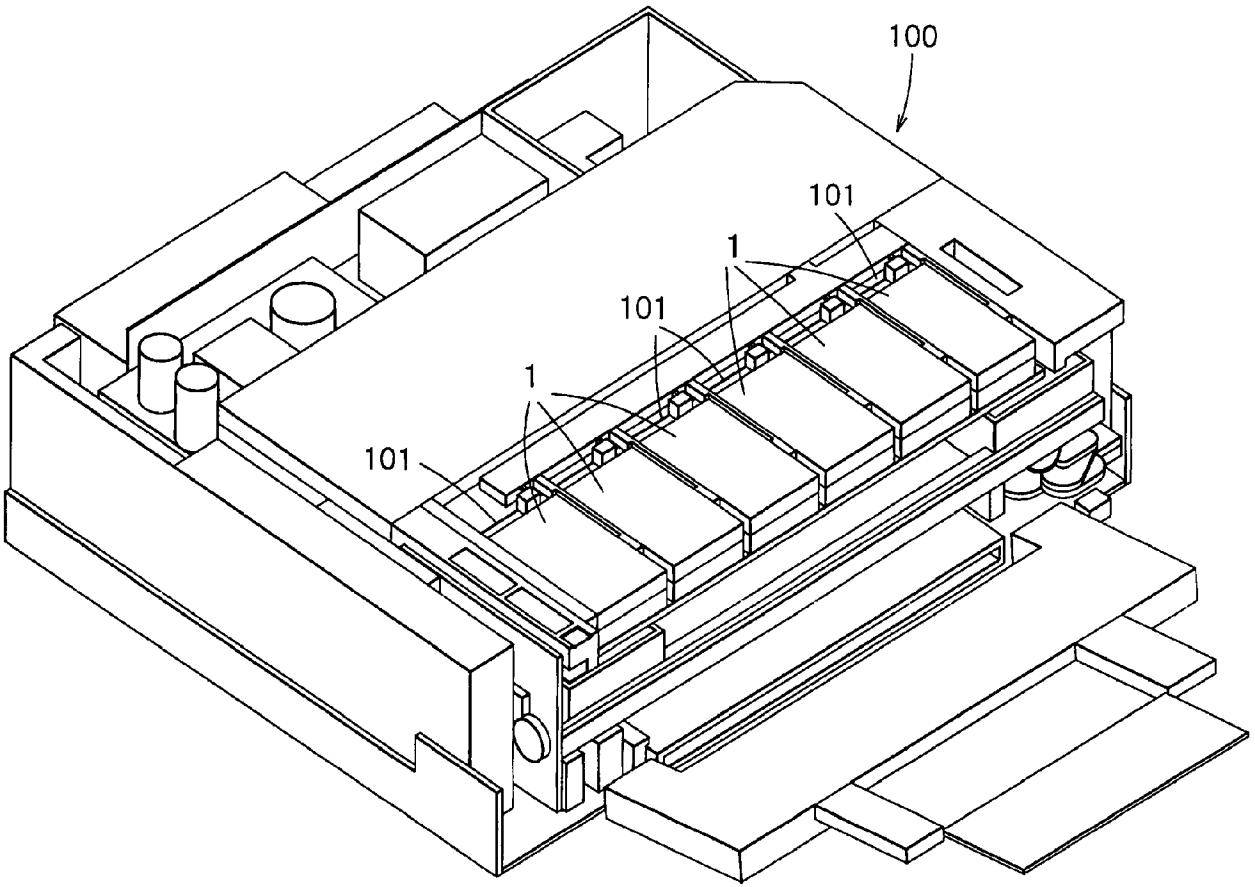
FIG. 1 is a perspective view showing an ink cartridge according to one embodiment of the invention and a cartridge mounting part of an ink jet type recording apparatus to which this ink cartridge is mounted.

FIG. 1 is a perspective view showing several ink cartridges 1 according to the embodiment and a cartridge mounting part 101 of an ink jet type recording apparatus to which these ink cartridges 1 are mounted. In this example, six cartridge mounting parts 101 are provided for the ink jet type recording apparatus 100, and each cartridge mounting part 101 is opened on a front surface of the ink jet type recording apparatus 100. Further, the six cartridge mounting parts 101 are arranged adjacent to each other along a line on the same horizontal plane, and the six ink cartridges are arranged in a flat manner and adjacent to each other along a line.

Figure 2C:
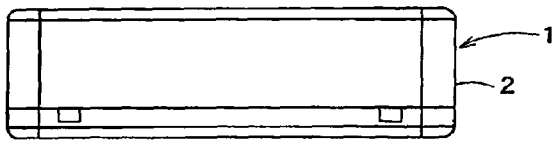
Figure 2A:
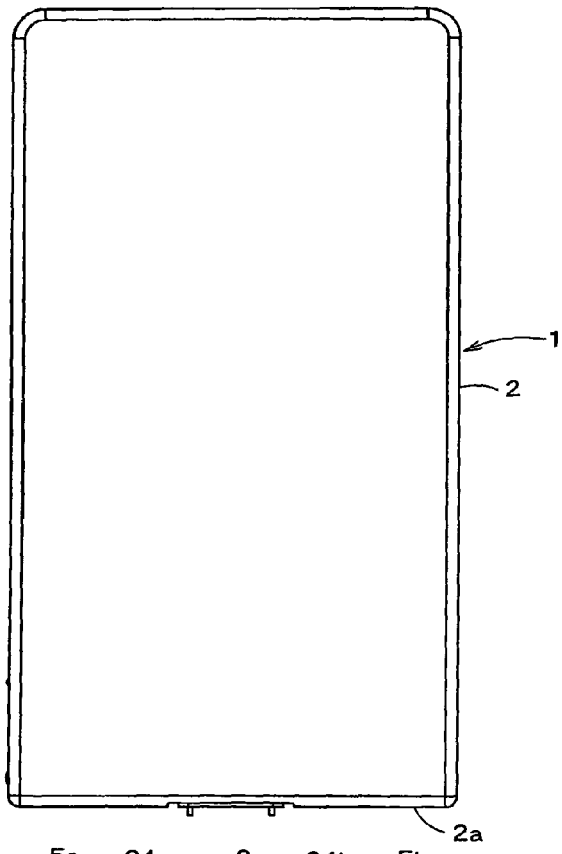
Figure 2B:
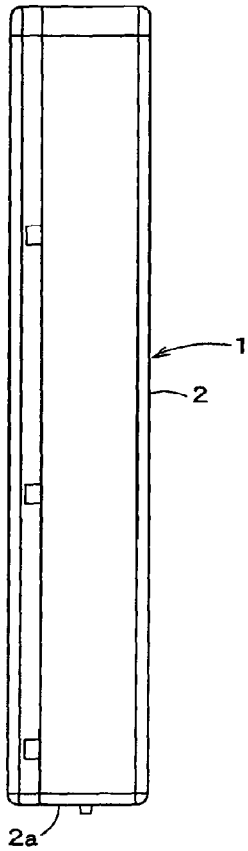
Figure 2D:
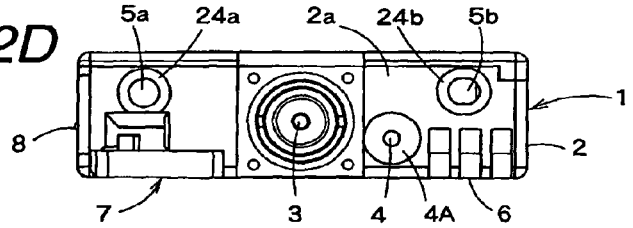
Figure 3A:
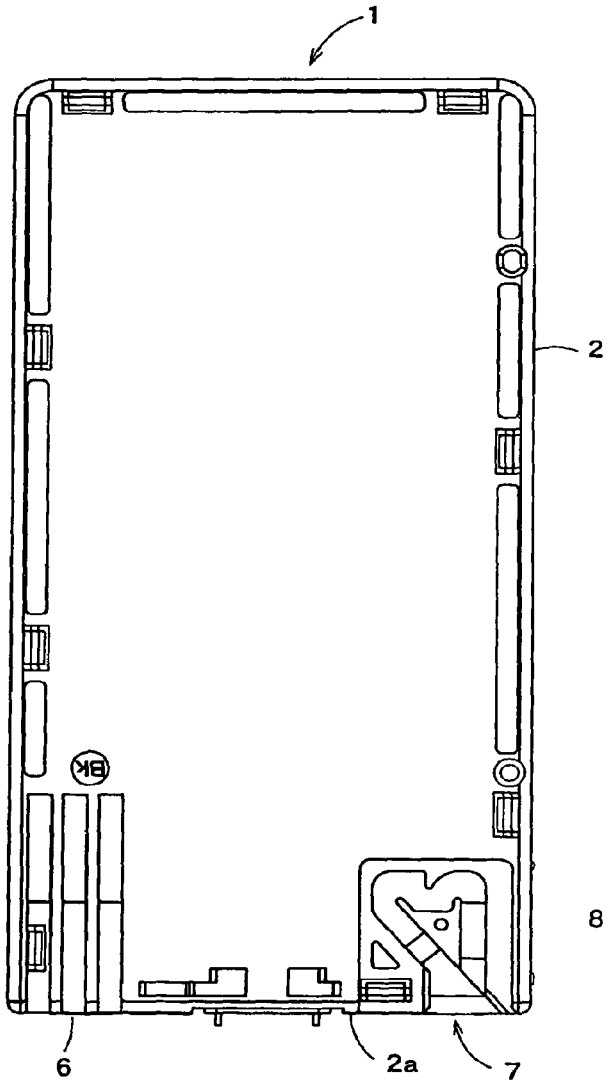
Figure 3B:
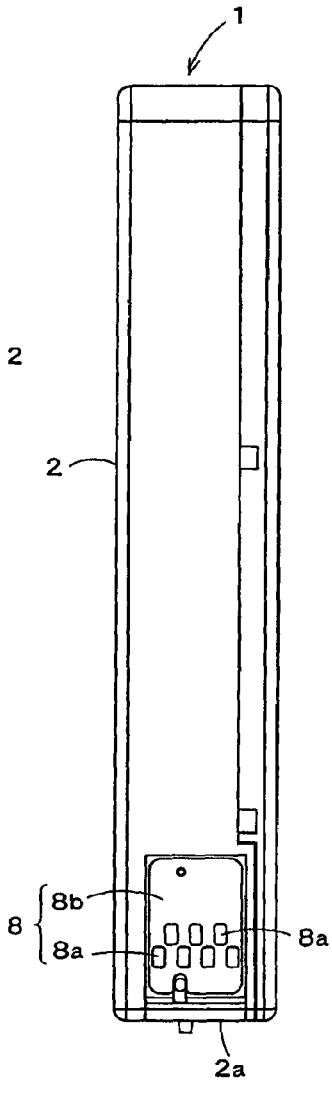

FIGS. 2 to 4 are diagrams respectively showing an exterior shape of one ink cartridge 1. The ink cartridge 1 has a container body 2 formed approximately in the shape of a rectangular parallelepiped, and an ink supply port 3 from which ink is fed out to the ink jet type recording apparatus 100 is formed at a central portion of a front surface 2*a*, of this container body 2.

In other words, the ink cartridge's container body is generally rectangular, meaning it is a structure having walls at least part of which lie in X, Y and Z planes. The present invention therefore contemplates variant structures such as cartridge bodies where one or more corners are clipped off, or portions of the flat walls are curved or lie in other planes.

Likewise, the term "proximate to a corner" is used generally, and covers the positioning of a structure relative to a corner where some benefit is derived by virtue of the proximity of the structure to that corner.

Positional terms like "top" and "bottom" are relative, and depend upon the orientation of the ink cartridge. Thus, what is a top surface would become the bottom surface, upon inversion of the cartridge.

Further, the front surface 2*a*, of the container body 2 also includes a pressure fluid inlet 4 through which pressurized fluid (preferably, pressurized air) for pressurizing ink inside the container body 2 and feeding-out the ink from the ink supply port 3 is introduced into the container body 2.

Further, a pair of positioning holes 5*a*, and 5*b*, into which a pair of positioning projections 103*a* and 103*b* (see FIGS. 9 and 10) provided at the cartridge mounting part 101 are inserted is formed on the front surface of the container body 2. The positioning holes 5*a*, 5*b*, and the positioning projections 103*a*, 103*b* are used to position the ink cartridge 1 in a lateral (right and left) direction. Around the pair of positioning holes 5*a*and 5*b*, are formed cartridge-side positioning surfaces 24*a*, and 24*b*, which are brought into contact with apparatus-side positioning surfaces 104*a*, and 104*b*, (see FIGS. 9 and 10) of the cartridge mounting part 101 so as to perform positioning in the inserting direction of the ink cartridge 1. The pair of positioning holes 5*a*, and 5*b*, and the pair of cartridge-side positioning surfaces 24*a*, and 24*b*, constitute a cartridge-side positioning part.

Further, an erroneous mount preventing structure 6 is provided at a corner of the container body 2 including the front surface (2*a*), that is, at a corner on the opposite side to a cartridge-side fixing structure 7 side in relation to the ink supply port 3. This erroneous mount preventing structure 6 has such a shape as to properly mount a predetermined ink kind of ink cartridge 1 to a predetermined position when the ink cartridge 1 is attached to the ink jet type recording apparatus 100, and to prevent mounting of any cartridge that is not the proper ink type of ink cartridge.

By way of non-limiting example, the erroneous mount preventing structure 6 could have a number of grooves whose length, width and/or depth correspond to the color or type of ink which the ink cartridge contains. Yellow, magenta, cyan and black cartridges would all have different groove arrangements, thereby preventing mis-insertion of a cartridge in an incorrect printer receptacle.

Further, on a rear surface (bottom surface) of the container body 2, at the corner on the opposite side to the corner where the erroneous mount preventing structure 6 is provided, the cartridge-side fixing structure (a container fixing mechanism) 7 is provided adjacently to the front surface of the container body 2. This cartridge-side fixing structure 7, when the ink cartridge 1 is mounted to the container mounting part 101, regulates the movement of the ink cartridge 1 in the pulling direction so as to control insertion to and removal from the ink jet type recording apparatus. This cartridge-side fixing structure 7 also functions to hold the ink cartridge 1 at a predetermined position in the cartridge mounting part 101.

Though the cartridge-side fixing structure 7 is provided on the rear surface (the bottom surface) of the container body 2 in this embodiment, the cartridge-side fixing structure 7 is not to be limited in position to the rear surface of the container body 2 but can be located elsewhere, for example, on the upper surface of the container body 2.

Further, as depicted in FIG. 3(*b*), on one side surface of the container body 2, near the cartridge-side fixing structure 7, a circuit board 8*b*, equipped with an IC (semiconductor memory element) which stores data such as the kind of ink and the residual ink amount in the container is provided. On a surface of this circuit board 8*b*, an electrode (cartridge-side electrode) 8*a* which is electrically connected to the IC and comes into contact with an apparatus-side contact 113 (see FIGS. 9 and 10) of the recording apparatus body is provided, and the circuit board 8*b* and the electrode 8*a*, constitute a memory unit 8. The memory unit 8 is arranged at a position near the ink supply port 3 of the container body 2 as well as the cartridge-side fixing structure 7. Though the memory element and the electrode 8*a*, depicted in FIG. 4*b*, are formed on the circuit board 8*b*, in the embodiment, this structure is by example only and not limitation and other constructions could be used—for instance, the memory element and the electrode 8*a* can be formed on a flexible printed circuit and arranged at different positions on the container body 2.

More preferably, the memory element can be located near the same corner by which the cartridge-side fixing structure 7 and one of the positioning holes 5*a*, are formed. Such an arrangement allows for very precise positioning of all these cartridge structures.

As shown in FIG. 4(*b*), the cartridge-side fixing structure 7 is disposed between the ink supply port 3 and the memory device 8 in the lateral direction of the container main body 2.

Figure 5:
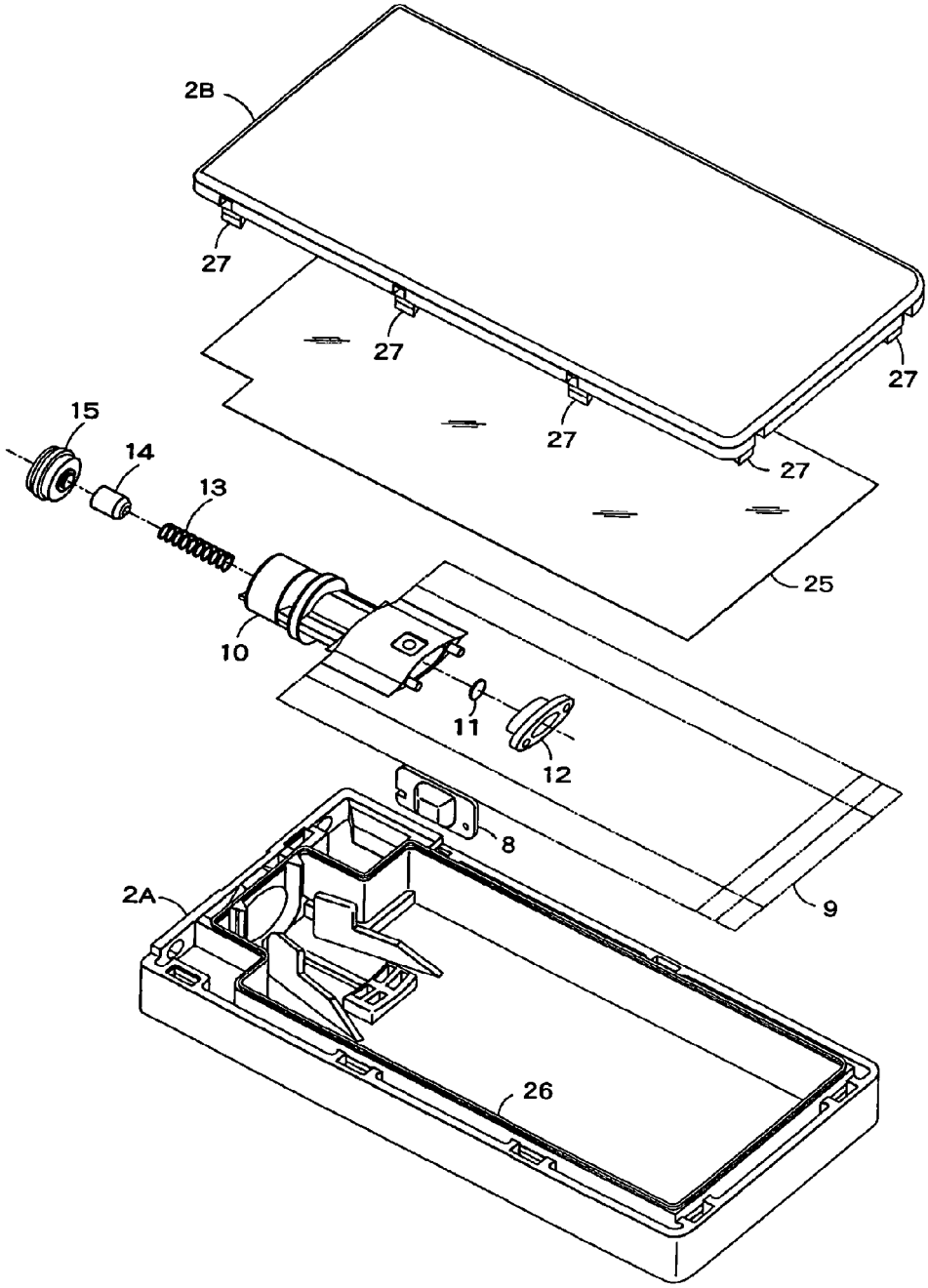
FIG. 5 is an exploded perspective view of the ink cartridge according to the embodiment of the invention.
Figures 6A, 6B, 6C, 6D:
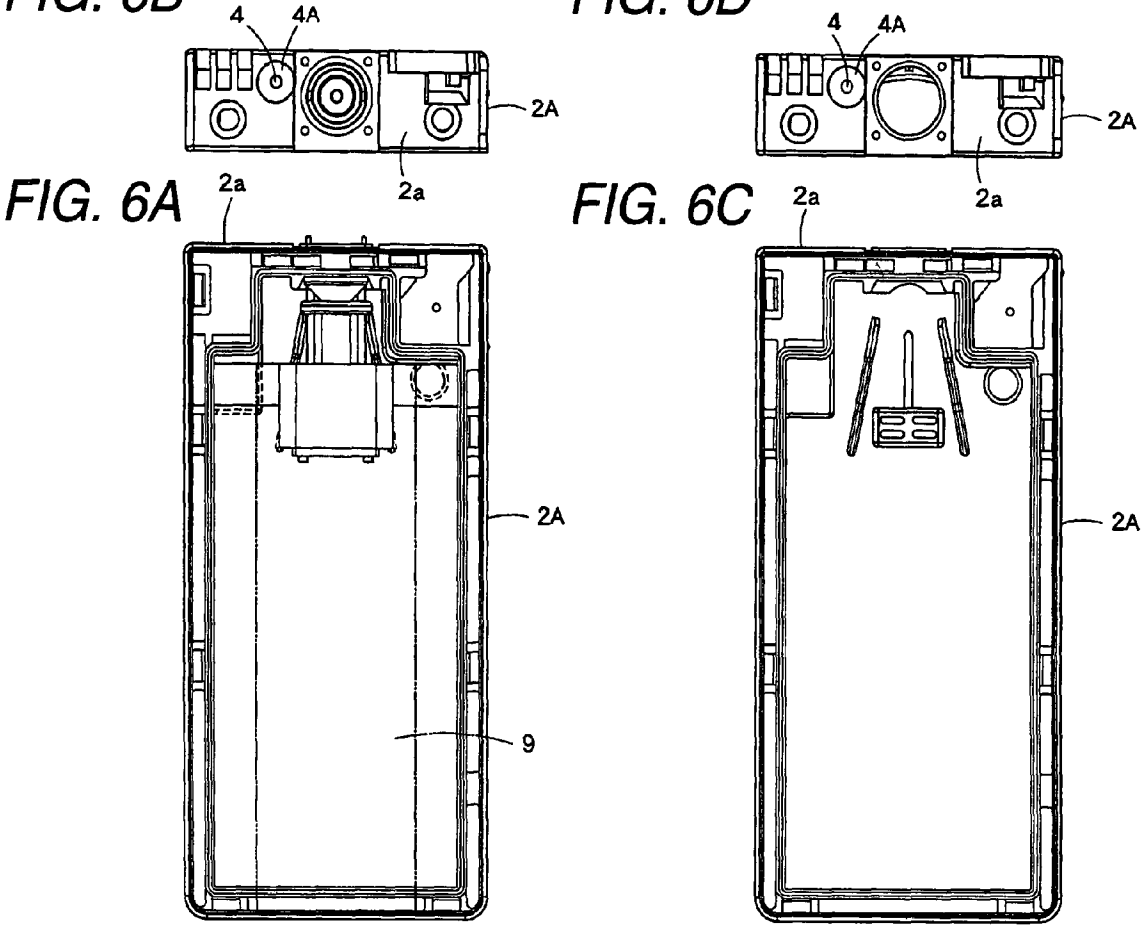

FIG. 5 is an exploded perspective view showing that the ink cartridge 1, and the container body 2 includes a case body 2A of which an upper surface is opened, and a lid member 2B seals the open upper surface of this case body 2A. FIG. 6 shows a state where the lid member 2B is removed from the ink cartridge 1.

As shown in FIGS. 5 and 6, an ink bag 9 having a flexible ink storing part (shown by broken lines for description) that is filled with ink is housed inside the container body 2. The ink bag 9 is affixed to a port part 10 through which the ink stored inside the ink bag 9 can be supplied to the outside. At an inside end part of this port part 10, a check valve 11 is arranged inside and a cap 12 is attached onto the check valve 11. On the other hand, at an outside end part of the port part 10, a spring seat 14 urged by a spring 13 is arranged inside and a seal supply cap 15 is attached.

A film 25 is fixed by heat-welding to a welding border 26, which is formed to surround the periphery of the region of the case body 2A in which the ink bag 9 is housed, thereby to make the inside of the case body 2A into closed space. This closed space is arranged so that the pressurized fluid (pressurized air in this embodiment) introduced from the pressure fluid inlet 4 is contained tightly and does not leak to the outside, and the ink storing part of the ink bag 9 is pressed by the pressurized fluid so that ink can be supplied to the outside. Further, the lid member 2B is fixed to the case body 2A by engagement projections 27 formed in the lid member 2B so as to cover the film 25 thereby to protect the film 25 and prevent useless expansion of the film 25 in the pressurizing time.

Figure 7:
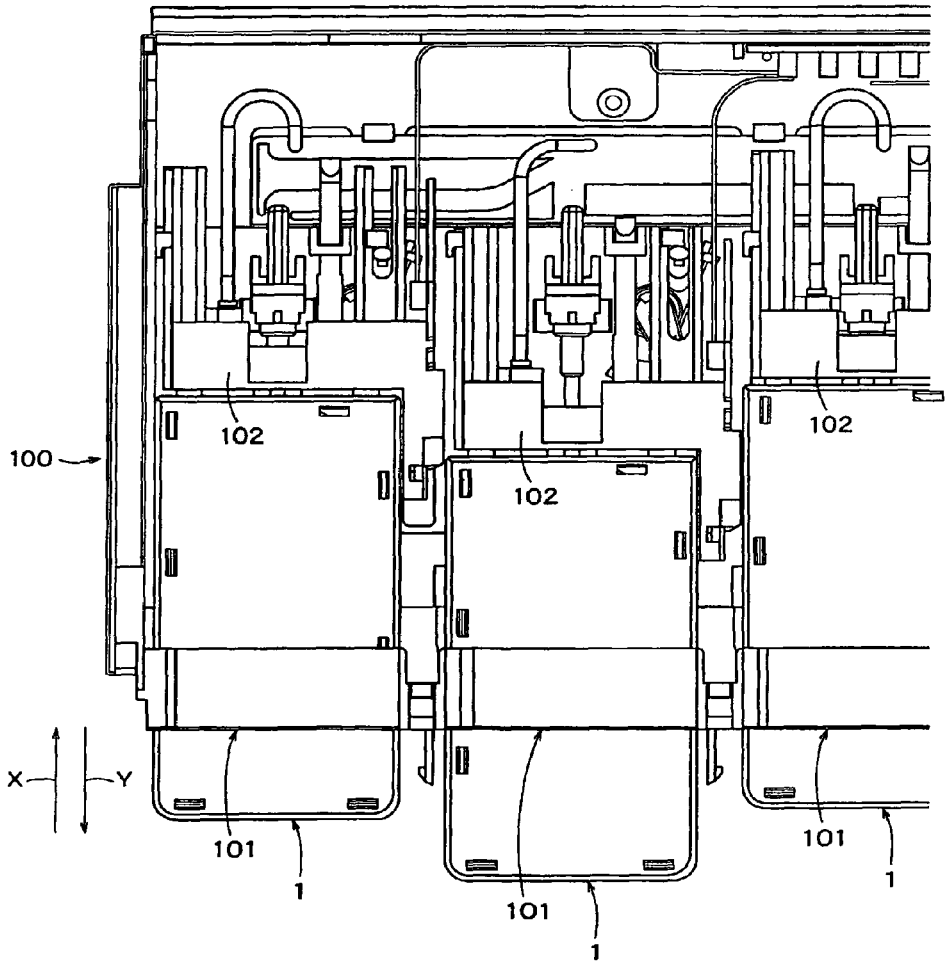
FIG. 7 is a plan view showing a state where the ink cartridge according to the embodiment of the invention is mounted to the cartridge mounting part of the ink jet type recording apparatus so as to show the apparatus inside.
Figure 8:
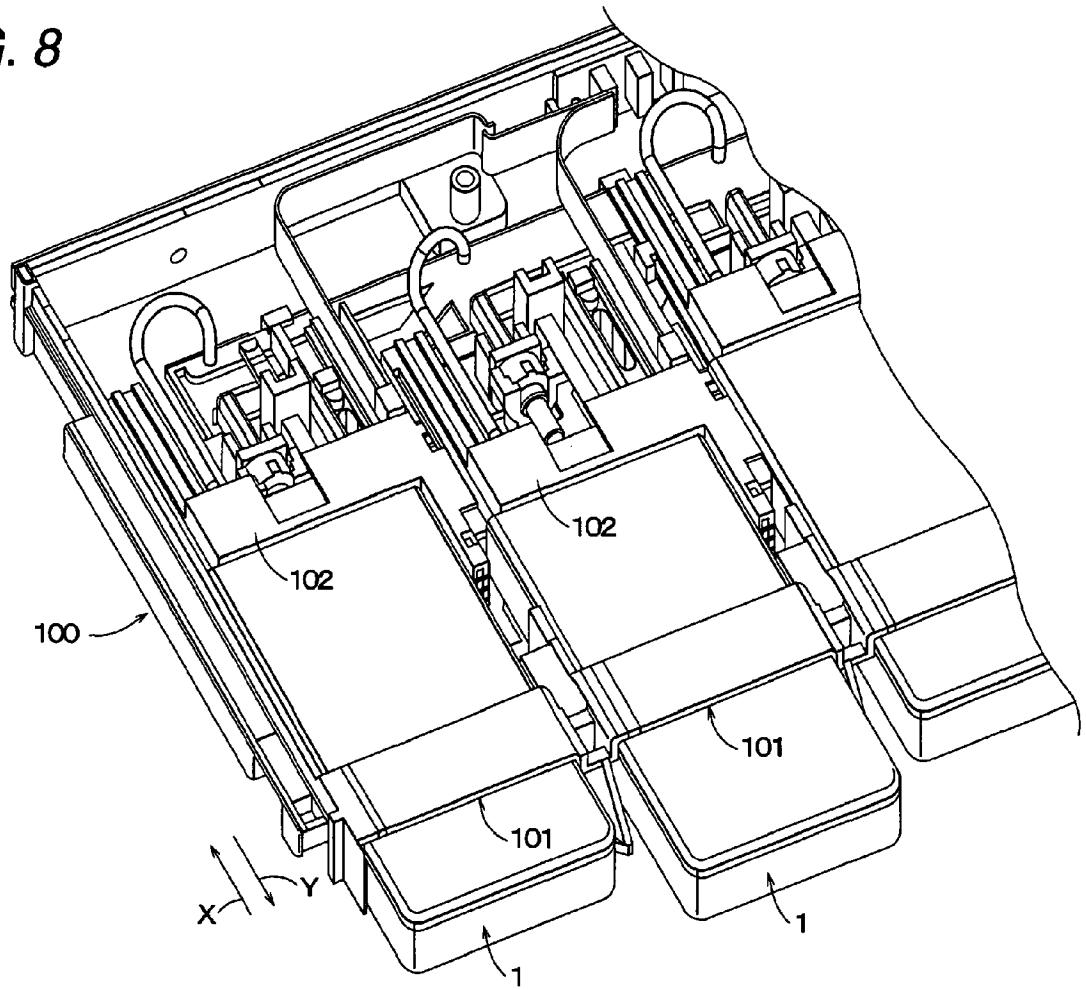
FIG. 8 is a perspective view showing the state where the ink cartridge according to the embodiment of the invention is mounted to the cartridge mounting part of the ink jet type recording apparatus so as to show the apparatus inside.

FIGS. 7 and 8 show respectively a state where the ink cartridges 1 are mounted to the cartridge mounting parts 101 of the ink jet type recording apparatus 100. For the cartridge mounting part 101, a slider member (translatingly movable member) 102 to which the front surface part of the ink cartridge 1 is connected is provided. This slider member 102 is provided slidably in the inserting and pulling (removing) directions of the ink cartridge 1, and urged by a spring unit in a direction (pulling direction Y) opposite to the inserting direction X of the ink cartridge 1.

Figure 9:
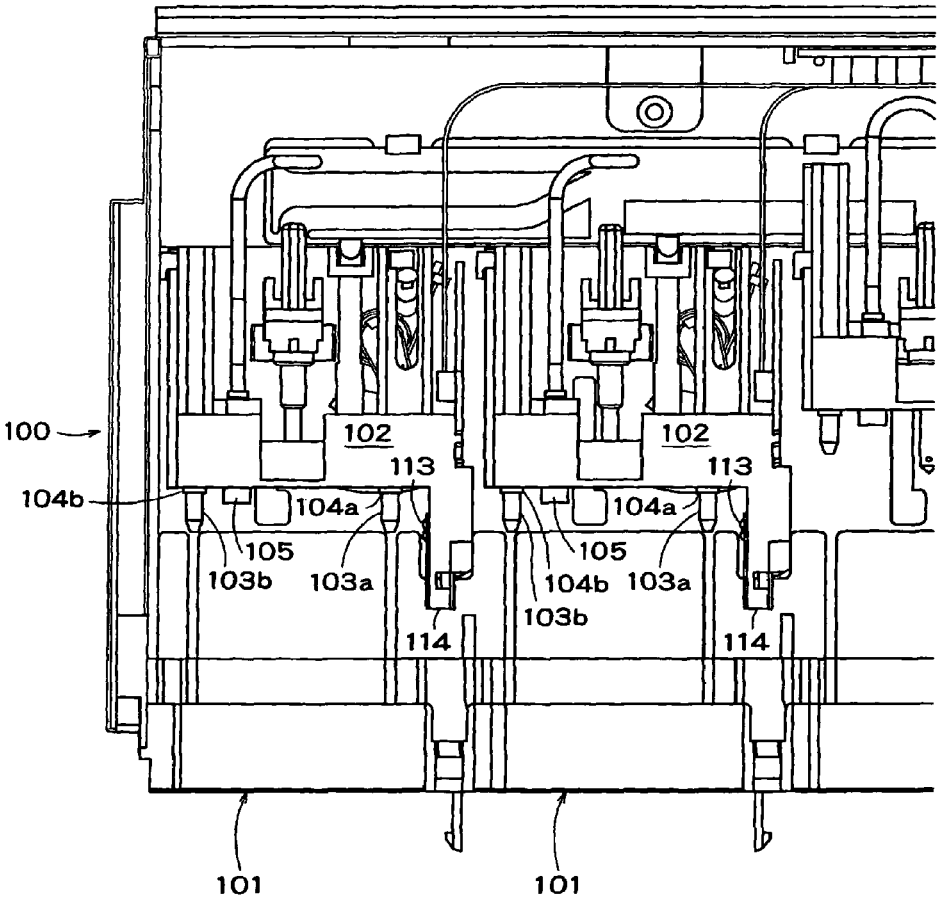
FIG. 9 is a plan view showing the cartridge mounting part of the ink jet type recording apparatus shown in FIG. 7 in a state where the ink cartridge has not been mounted yet so as to show the apparatus inside.
Figure 10:
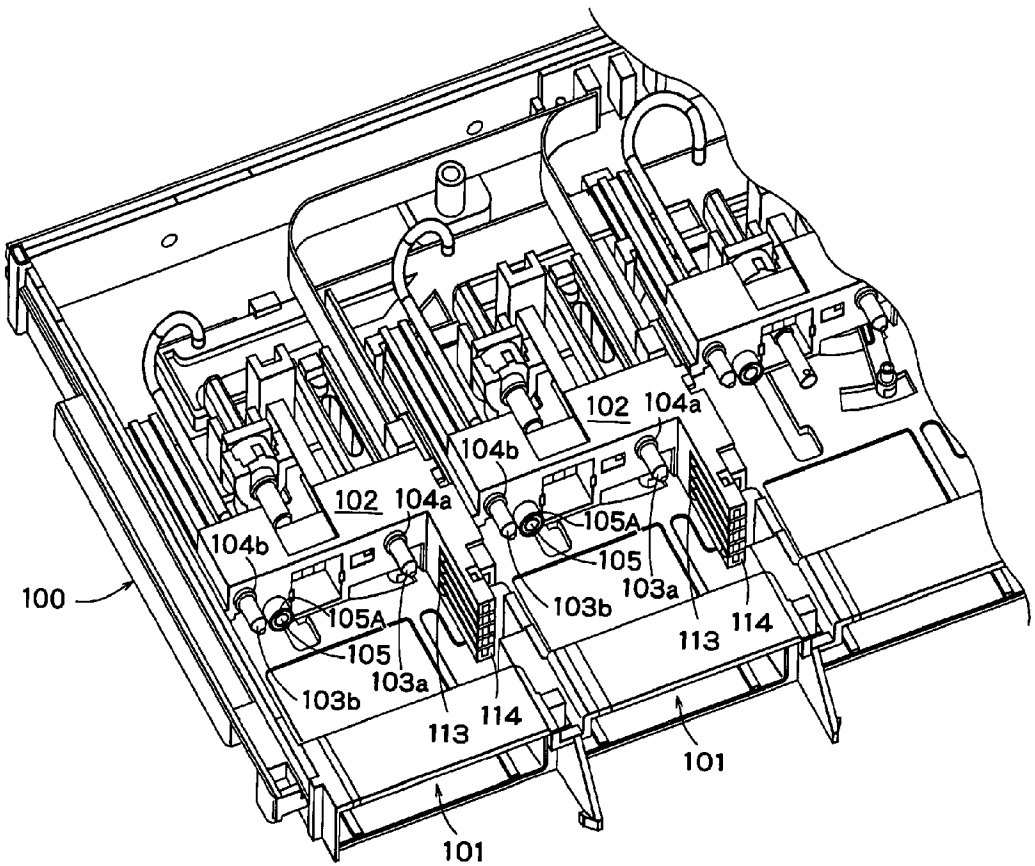
FIG. 10 is a perspective view showing the cartridge mounting part of the ink jet type recording apparatus shown in FIG. 8 in the state where the ink cartridge has not been mounted yet so as to show the apparatus inside.

FIGS. 9 and 10 show respectively the cartridge mounting part 101 in the state where the cartridge 1 is not mounted to the cartridge mounting part 101. A pair of positioning projections 103*a*, and 103*b*, are provided by a surface of the slider member 102 opposed to the ink cartridge front surface. For each base part of each positioning projection 103*a*, 103*b*, an apparatus-side positioning surface 104*a*, 104*b*, is provided by each shoulder part. The pair of positioning projections 103*a*, 103*b*, and the pair of apparatus-side positioning surfaces 104*a*, 104*b*, constitute an apparatus-side positioning part.

When the ink cartridge 1 is connected to the slider member 102, the pair of positioning projections 103*a*, 103*b*, are inserted into the corresponding pair of positioning holes 5*a*, 5*b*, located on the front surface of the ink cartridge 1, and the pair of cartridge-side positioning surfaces 24*a*, 24*b*, shown in FIG. 4(*d*) come into contact with the pair of apparatus-side positioning surfaces 104*a*, 104*b*.

Turning now to the pair of positioning holes 5*a*, 5*b*, the pair of positioning projections 103*a*, 103*b*, the pair of cartridge-side positioning surfaces 24*a*, 24*b*, and the pair of apparatus-side positioning surfaces 104*a*, 104*b*, it is preferable for one positioning hole 5*a*, one positioning projection 103*a*, one cartridge-side positioning surface 24*a*, and one apparatus-side positioning surface 104*a*, which are located closer to the memory device 8, to have a function of positioning the ink cartridge 1 in relation to the slider member 102 more precisely. Especially, positioning of the ink cartridge 1 in the inserting direction is precisely performed by the cartridge-side positioning surface 24*a*, and the apparatus-side positioning surface 104*a*.

Figure 4C:
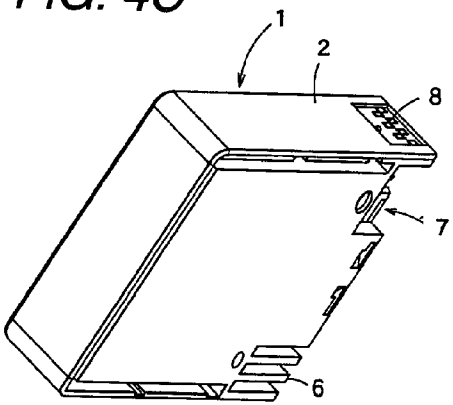
Figure 4D:
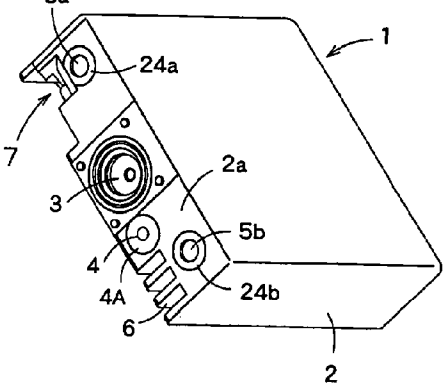
Figure 4A:
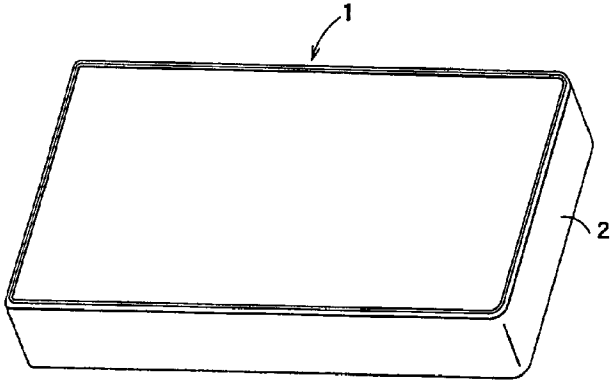
Figure 4B:
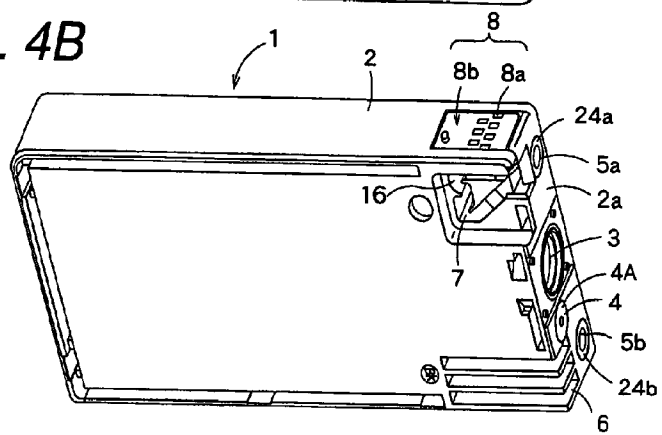

As is clear from FIGS. 2D, 4B and 4D, the positioning holes 5*a*, and 5*b*, are preferably arranged so that lines passing perpendicularly through those holes themselves lie in a plane that is parallel to the bottom of the ink cartridge, and the bottom groove of the ink cartridge-side fixing structure.

Also, with reference to FIGS. 2D, 4B-D and 15A-B, it will be recognized that the positioning holes are overlapped by the imaginary extensions (or projections) of the adjoining cartridge-side fixing structure 7 and erroneous mount preventing structure 6.

As apparent from FIG. 4B, the positioning hole 5*a*, and the cartridge-side positioning surface 24*a*, that are used for precise positioning and that constitute a container-side positioning portion are arranged near the memory unit 8 including the electrode 8*a*, and between the ink supply port 3 and the memory unit 8 having the electrode 8*a*, in the lateral direction of the container main body 2. This way, the positioning hole 5*a*, the cartridge-side positioning surface 24*a*, and the cartridge-side fixing structure 7 are arranged in the vicinity of the memory unit 8.

Further, the positioning hole 5*a*, and the cartridge-side fixing structure 7 are arranged so that the positioning projection 103*a*, inserted into the positioning hole 5*a*, and the cartridge-side fixing structure 7 are superimposed on each other in the thickness direction of the container body 2. As a result, the memory unit can be positioned relative to the corresponding contact structure of the printer with improved accuracy.

Figure 11B:
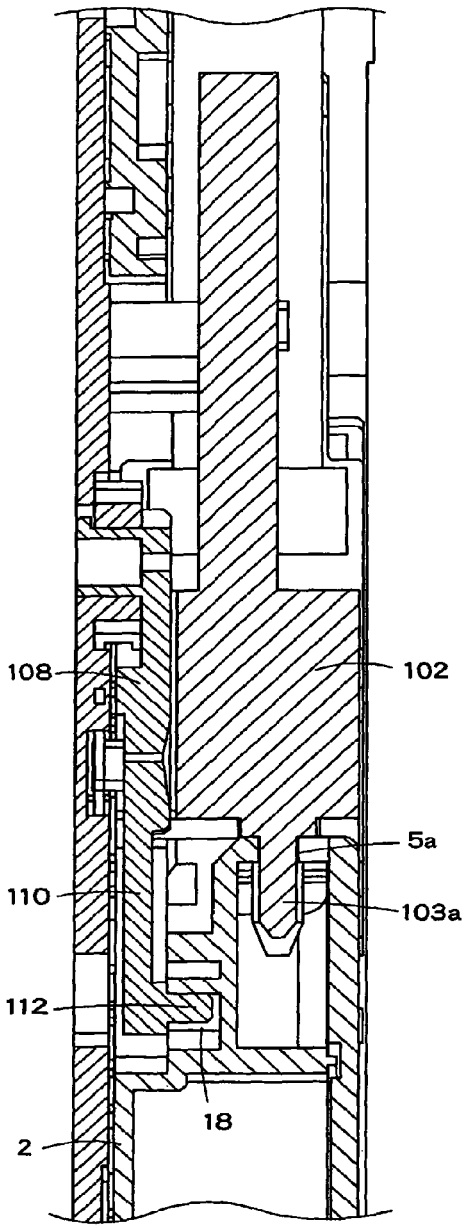
FIG. 11B is a side cross-sectional view taken along a line b-b in FIG. 11A.
Figure 11A:
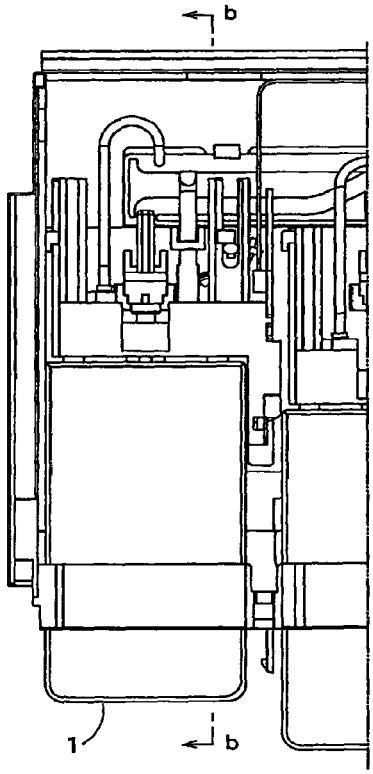
FIG. 11A is a top plan view showing the state where the ink cartridge according to the embodiment of the invention is mounted to the cartridge mounting part of the ink jet type recording apparatus so as to show the apparatus inside.

FIGS. 11A and 11B show respectively a state where the ink cartridge 1 is precisely positioned with respect to the slider member 102 by the positioning hole 5*a*, the positioning projection 103*a*, the cartridge-side positioning surface 24*a*, and the apparatus-side positioning surface 103*a*. A fixing pin 112 of the apparatus-side fixing structure 107 is inserted and held in a fixing part 18 of a guide groove 16 of the container body 2.

Further, as shown in FIGS. 9 and 10, a pressure fluid port 105 to be connected to the pressure fluid inlet 4 of the ink cartridge 1 is provided on the surface of the slider member 102 opposed to the front surface of the ink cartridge. This pressure fluid port 105 is elastically supported on the slider member 102 by an elastic member such as a spring so that the pressure fluid port 105 can project from and retract into the slider member 102.

Although the pressure fluid port 105 is elastically supported by the slider member 102 in this embodiment, the pressure fluid port 105 may be disposed on a stationary structure portion of the cartridge mounting part 101 similarly to the ink supply needle 106.

Further, as shown, for example, in FIGS. 2(*d*), 4(*b*) and 4(*d*), a container-side abutment portion 4A is formed around the pressure fluid inlet port 4 on the front surface 2*a*, of the container body 2. This container-side abutment portion 4A is located on the front surface 2*a*, of the container body 2 and at an opposite side of the ink supply port 3 to the memory unit 8. The container-side abutment portion 4A abuts elastically against the top surface of the pressure fluid port 105 (an apparatus-side abutment portion) when the ink cartridge 1 is mounted onto the cartridge mounting part 101.

Further, as shown in FIGS. 9 and 10, a contact protrusion part 114 having an apparatus-side contact 113 to be connected to the electrode 8*a*, of the memory unit 8 is provided at one end of the front surface of the slider member 102.

Figure 12:
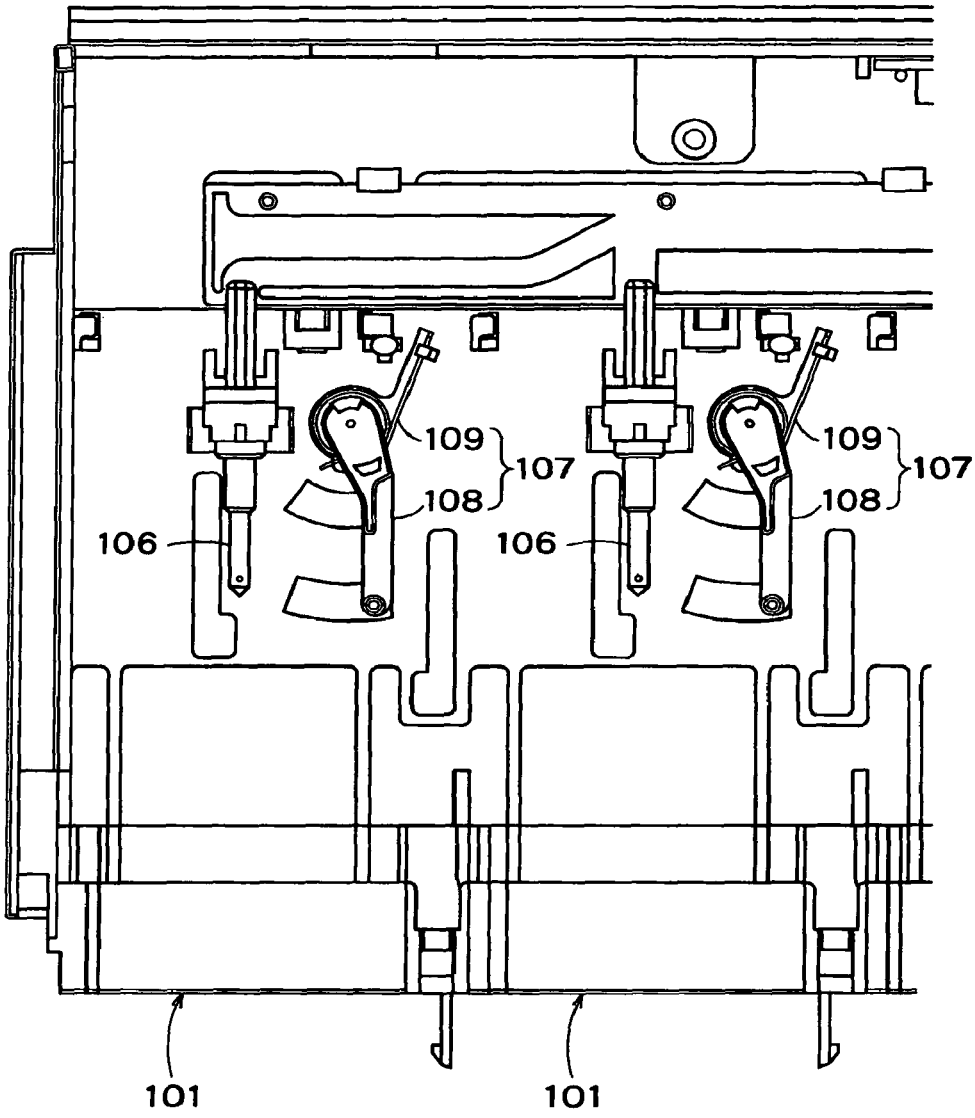
FIG. 12 is a top plan view showing the cartridge mounting part of the ink jet type recording apparatus shown in FIG. 7 in a state where a slider is removed so as to show the apparatus inside.
Figure 13:
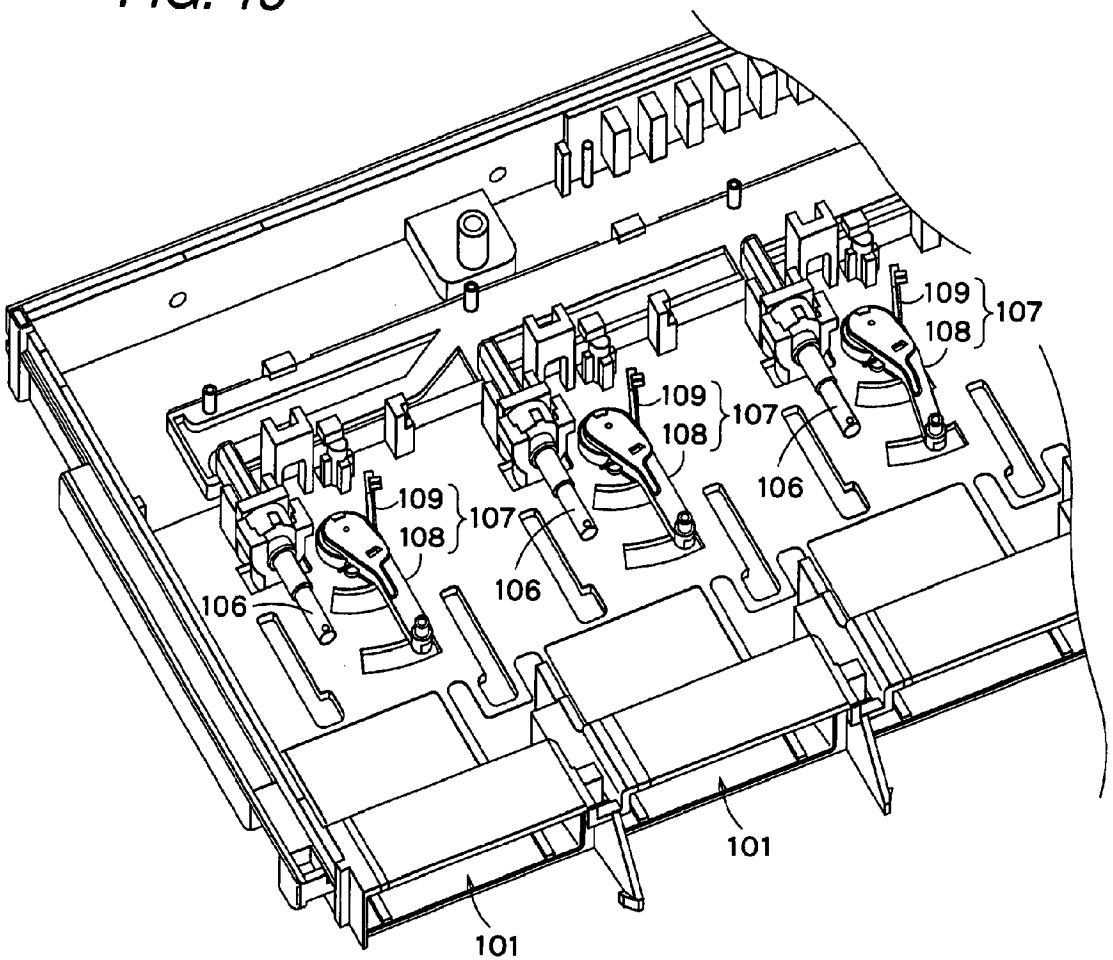
FIG. 13 is a perspective view showing the cartridge mounting part of the ink jet type recording apparatus shown in FIG. 8 in the state where the slider is removed so as to show the apparatus inside.

FIGS. 12 and 13 show respectively a state where the slider member 102 is removed from the cartridge mounting part 101. An ink supply needle 106 is secured inside the cartridge mounting part 101. The ink cartridge 1 is pushed in together with the slider member 102, whereby the ink supply needle 106 is inserted into the ink supply port 3 of the ink cartridge 1.

It should be understood that the ink supply port 3 is in communication with the interior of the ink cartridge 1. By this it is meant that there is fluid communication between the ink supply port 3 and a region inside the ink cartridge 1, such as the interior of the ink bag 9 contained therein. Such communicating also would cover a structure where the ink bag is omitted and the ink supply port has access directly to the interior of the ink cartridge.

Further, inside the cartridge mounting part 101, the apparatus-side fixing structure 107 is provided, which regulates releasably the movement of the ink cartridge 1 in the pulling direction in cooperation with the cartridge-side fixing structure 7.

The apparatus-side fixing structure 107 has a turn lever member 108. This turn lever member 108 is supported rotatably about its base end part so that it can pivot, and is urged by a spring member 109 in one rotating direction (counterclockwise for the structure depicted in FIG. 12).

Figure 14A:
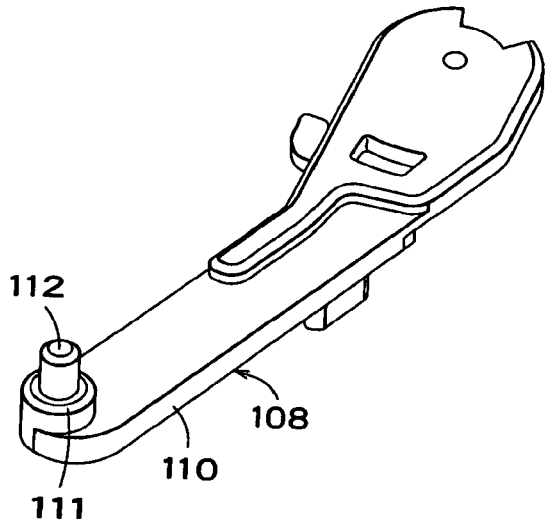
Figure 14B:
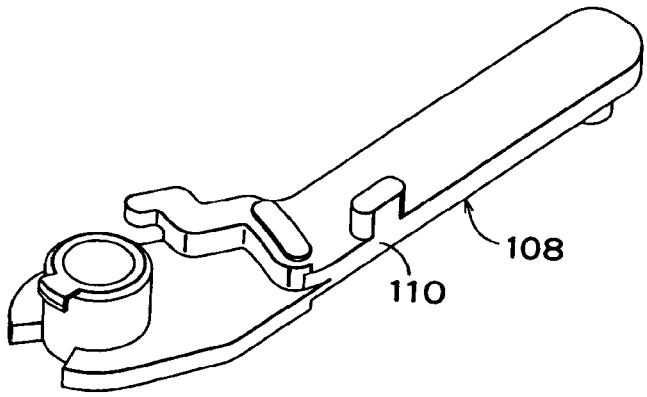
Figure 15A:
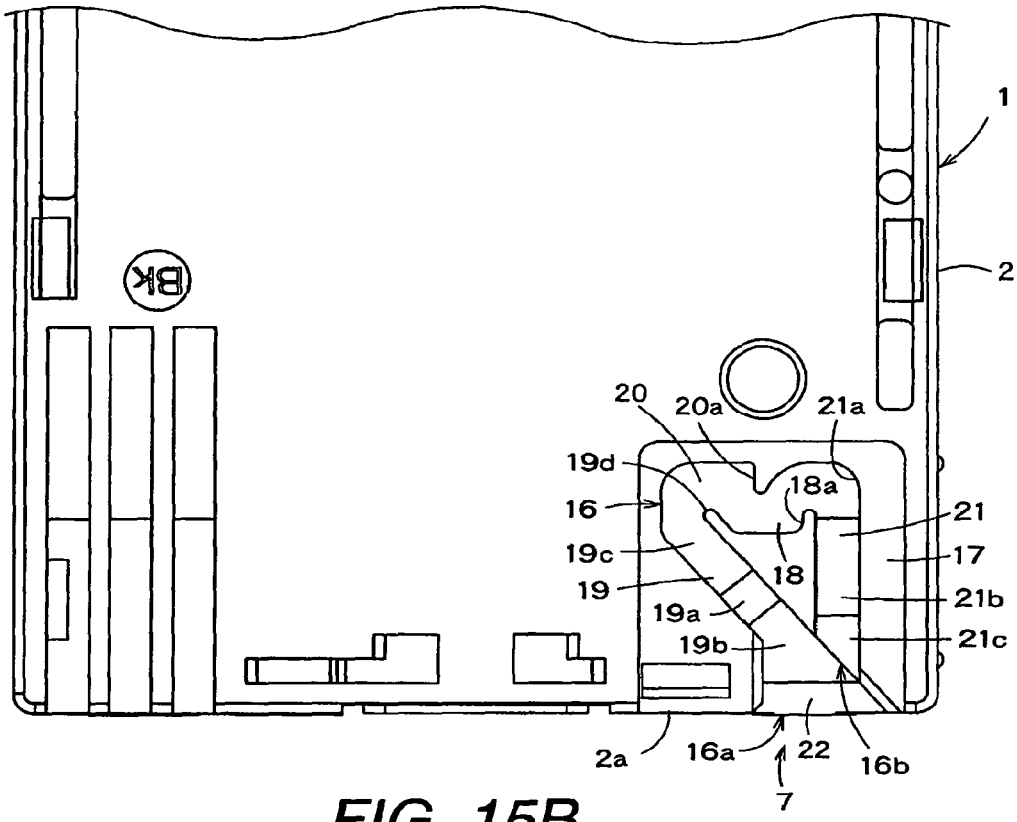
Figure 15B:
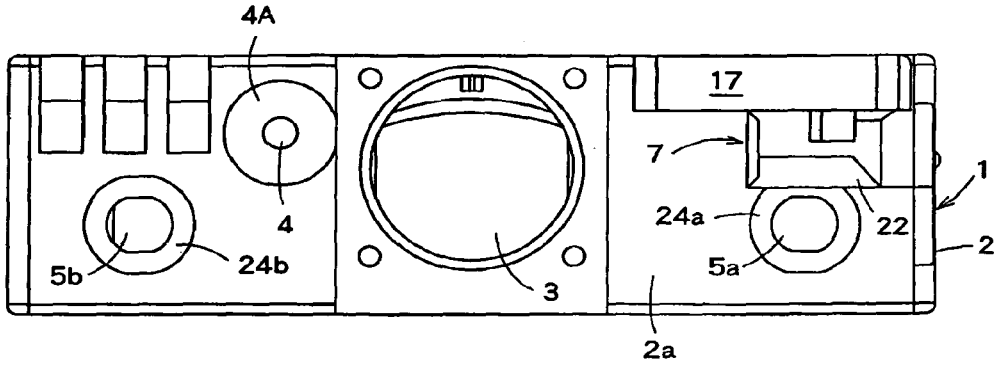

As shown in FIG. 14, the turn lever member 108 comprises an elongate lever body 110, an approximately cylindrical pin attaching part 111 provided at a leading end of this lever body 110, an approximately cylindrical fixing pin 112 which is provided on a top surface of this pin attaching part 111 and which is smaller in diameter than the pin attaching part 111.

Figure 16A:
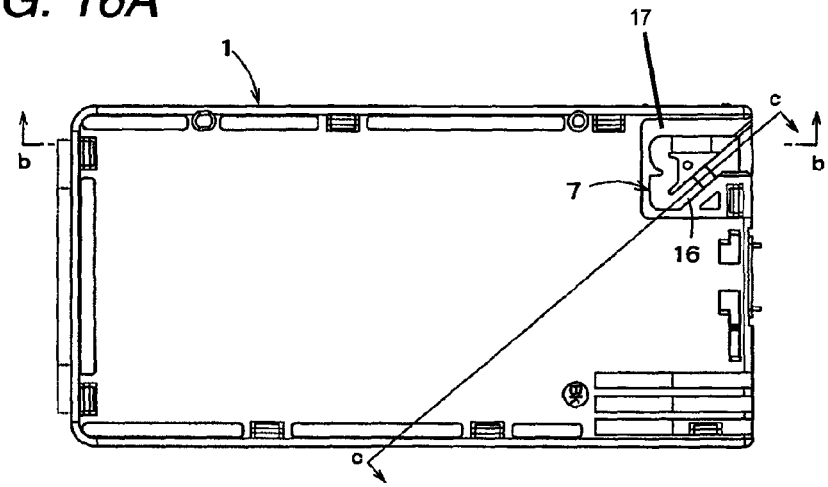
Figure 16B:
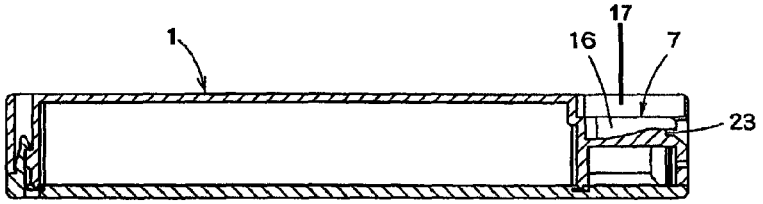
Figure 16C:
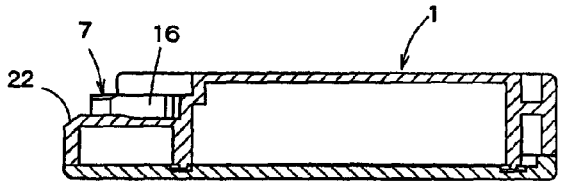

As shown in FIGS. 15 and 16, the cartridge-side fixing structure 7 is composed of the guide groove 16 having a rectangular section, into which the fixing pin 112 is inserted. A recess part 17 is formed at a corner on the cartridge rear surface near the positioning hole 5*a*, and the cartridge-side positioning surface 24*a*, which are used for positioning the cartridge with high accuracy. The guide groove 16 is provided in a recessed manner at the bottom of this recess part 17. The bottom surface of this guide groove 16 is made perpendicular to the side surface of the container body 2 on which the memory unit 8 is arranged.

In mounting and removal operations of the ink cartridge 1 to and from the cartridge mounting part 101, the fixing pin 112 of the turn lever member 108 of the apparatus-side fixing structure 107 is guided by the guide groove 16 of the cartridge-side fixing structure 7.

The guide groove 16 includes the fixing part 18 to which the fixing pin 112 is engaged in the state where the ink cartridge 1 is mounted to the cartridge mounting part 101 and which regulates the movement of the ink cartridge 1 in the pulling direction.

Further, the guide groove 16 includes an entrance-side guide part 19 which guides the fixing pin 112 when the ink cartridge 1 is inserted into the cartridge mounting part 101; an intermediate guide part 20 which leads the fixing pin 112 to the fixing part 18 when the ink cartridge 1 that has been inserted into the cartridge mounting part 101 is pushed backward in the pulling direction; and an exit-side guide part 21 which guides, to the exit of the guide groove 16, the fixing pin 112 released from the fixing part 18 by pushing the ink cartridge 1 in the insertion direction when the ink cartridge 1 is removed from the cartridge mounting part 101.

A main portion (linear portion) of the entrance-side guide part 19 of the guide groove 16 is provided to extend at an angle of about 30° to 50° relative to the inserting/pulling direction. Further, an end of the entrance-side guide part 19 is formed to present a curved shape by a projection-shaped wall part 19*d*.

Further, an entrance slant surface 22 is formed at an entrance part 16*a*, of the guide groove 16. This entrance slant surface 22 slants so that a groove depth becomes shallower in the moving direction of the fixing pin 112 that relatively moves in association with the inserting operation of the ink cartridge 1 into the cartridge mounting part 101.

A width of the entrance slant surface 22 is set larger than a groove width of the main portion of the guide groove 16 including the fixing part 18 and being formed with the nearly same width. Further, the width of the entrance slant surface 22 is set larger than the diameter of the pin attaching part 111 to which the fixing pin 112 is attached. On the other hand, the groove width of the main portion of the guide groove 16 is set smaller than the diameter of the pin attaching part 111.

Further, a deep groove forming slant surface 19*a*, is formed at the entrance-side guide part 19 between the entrance slant surface 22 and the fixing part 18, which slant surface 19*a*, slants so that the guide groove 16 becomes deeper in the moving direction of the fixing pin 112 that relatively moves in association with the inserting operation of the ink cartridge 1 into the cartridge mounting part 101. A flat part 19*b*, is formed between this deep groove forming slant surface 19*a*, and the entrance slant surface 22. Further, a flat part 19*c*, is formed, continuing from the deep groove forming slant surface 19*a*.

The depth of the guide groove 16 at the shallowest part formed by the entrance slant surface 22, that is, the groove depth of the flat part 19*b*, is smaller than the length of the fixing pin 112. Further, the depth of the guide groove 16 at the deepest part formed by the deep groove forming slant surface 19*a*, that is, the groove depth of the flat part 19*c*, is larger than the length of the fixing pin 112.

Further, the intermediate guide part 20 of the guide groove 16 includes a temporarily stopping side wall part 20*a*, which stops temporarily the fixing pin 112, moving in the direction of the fixing part 18, in front of the fixing part 18 when the ink cartridge 1 has been inserted into the cartridge mounting part 101 to a sufficient depth.

Further, the fixing part 18 of the guide groove 16 includes a final stopping side wall part 18*a*, which receives and stops in a predetermined position the fixing pin 112 that has been released from the temporarily stopping side wall 20*a*, and moves to the fixing part 18 when the ink cartridge 1 inserted into the cartridge mounting part 101 to a sufficient depth is pushed back in the pulling direction, thereby stopping the fixing pin 112.

Further, a curved side wall part 21*a*, is formed at a start end of the exit-side guide part 21, a linear slant surface 21*b* is formed continuing from this curved side wall part 21*a*, and further, a linear flat part 21*c*, is formed continuing from the slant surface 21*b*.

Further, an exit part 16*b*, of the guide groove 16 is connected to the entrance part 16*a*, whereby the guide groove 16 forms a loop as a whole. In the connection part between the entrance part 16*a*, and the exit part 16*b*, the groove depth of the exit part 16*b*, is shallower than the groove depth of the entrance part 16*a*, whereby a step part 23 (shown in FIG. 16B) is formed at the connection part. This step part 23 prevents the fixing pin 112 from entering the flat part 21*c*, when the ink cartridge 1 is inserted into the cartridge mounting part 101.

Next, the operation of the fixing pin 112 into the guide groove 16 in the mounting and removal operation of the ink cartridge 1 will be described with reference to FIG. 17. It should be understood that arrow Z in FIG. 17 represents an urging direction of the turn lever member 108 resulting from the biasing action of the spring member 109.

Figure 17:
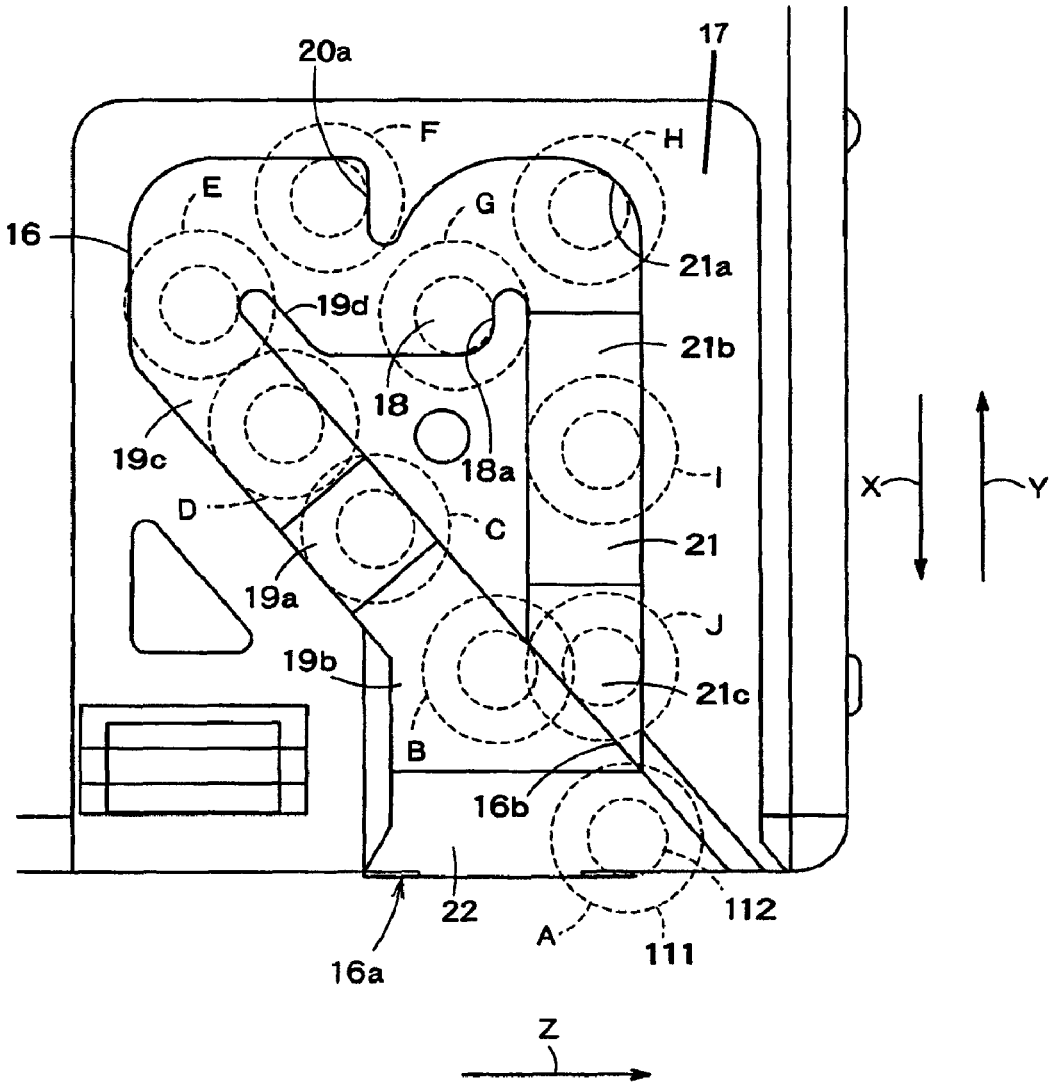
FIG. 17 is a diagram showing the motion of a fixing pin along a guide groove when the ink cartridge according to the embodiment of the invention is mounted and removed.

After the ink cartridge 1 has inserted into the cartridge mounting part 101 and connected to the slider member 102, when the ink cartridge 1 is further pushed in the insertion direction X against the urging force of the slider member 102, the fixing pin 112 of the turn lever member 108 is inserting into the entrance part 16*a*, of the guide groove 16 (position A in FIG. 17).

Since the entrance slant surface 22 is formed at the entrance part 16*a*, of the guide groove 16, the fixing pin 112, sliding on this entrance slant surface 22, moves in the opposite direction to the groove depth direction. Hereby, the turn lever member 108 or a member supporting the turn lever member 108 deforms elastically, so that force urging the fixing pin 112 toward the bottom surface of the guide groove 16 is produced.

When the leading end of the fixing pin 112 firstly comes into contact with the entrance slant surface 22, the top surface of the pin attaching part 111 is located in the lower position than the edge level of the guide groove 16. While the fixing pin 112 moves on the entrance slant surface 22, the groove depth changes so that the top surface of the pin attaching part 111 exceeds the edge level of the guide groove 16.

When the fixing pin 112 passes through the entrance slant surface 22 and next gets over the flat part 19*b*, (position B in FIG. 17), only the fixing pin 112 is inserted into the guide groove 16, and the pin attaching part 111 is located outside the guide groove 16. This is because the depth of the guide groove 16 at the flat part 19*b*, is set smaller than the length of the fixing pin 112.

By thus providing the entrance slant surface 22 for the entrance part 16*a*, of the guide groove 16, it is possible to prevent, when the fixing pin 112 is inserted into the entrance part 16*a* of the guide groove 16, the fixing pin 112 from being caught by the front surface of the ink cartridge 1, so that the insertion of the fixing pin 112 into the entrance part 16*a*, of the guide groove 16 can be performed smoothly and surely.

Further, since the entrance slant surface 22 is formed and the groove depth of the flat part 19*b*, continuing from this surface 22 is set smaller than the length of the fixing pin 112, even in case that the width of the entrance part 16*a*, of the guide groove 16 is set large and the width of the groove continuing from this part 16*a*, is made narrow like that in the embodiment, the pin attaching part 111 is not caught in the narrow-width part of the guide groove 16. By setting the width of the entrance part 16*a*, of the guide groove 16 large, the fixing pin 112 can be inserted into the guide groove 16 surely.

When the ink cartridge 1 is further pushed in the inserting direction X, the fixing pin 112 passes through the flat part 19*b*, and moves in the groove depth direction (position C in FIG. 17), sliding on the deep groove forming slant surface 19*a*.

When the fixing pin 112 passes through the deep groove forming slant surface 19*a*, and comes to the position of the flat part 19*c*, (position D in FIG. 17), the peripheral edge part of the top surface of the pin attaching part 111 fits to the edge part of the guide groove 16 and is pressed against this edge part. This is because of the continuing elastic deformation produced in the turn lever member 108 when the fixing pin 112 passes through the entrance slant surface 22 and which is still present at this time. By thus fitting the peripheral edge part of the top surface of the pin attaching part 111 to the edge part of the guide groove 16, it is possible to prevent the turn lever member 108 from coming into contact with the surface including the edge part of the guide groove 16 (bottom surface of the recess part 17), thereby preventing the fixing pin 112 from rising out of the guide groove 16.

Further, when the fixing pin 112 comes to the position of the flat part 19*c*, (position D in FIG. 17), the leading end of the fixing pin 112 is separated from the bottom surface of the guide groove 16. This is because the groove depth of the flat part 19*c*, is set larger than the length of the fixing pin 112.

When the ink cartridge 1 is further pushed in the inserting direction X, and the fixing pin 112 exceeds the position (position E in FIG. 17) near the leading end of the projection-like wall part 19*d*, located at the end of the entrance-side guide part 19, the fixing pin 112 moves in the direction Z by the urging force of the spring member 109. Then, the fixing pin 112 strikes with the temporarily stopping side wall 20*a*, and stops (position F in FIG. 17). At this time, an audible click is produced. Upon hearing this click, the user is able to confirm that the ink cartridge 1 has been inserted to sufficient depth.

When the user stops pressing the ink cartridge 1 in the inserting direction X, the ink cartridge 1 is pushed back slightly in the pulling direction Y (that is, toward the user) by the urging force of the slider member 102. Hereby, engagement of the fixing pin 112 to the temporarily stopping side wall 20*a*is released, and the fixing pin 112 moves in the direction Z in response to the urging force of the spring member 109. Then, the fixing pin 112 collides with the lastly stopping side wall 18*a*, and stops in the fixing position (position G in FIG. 17), and an audible click is produced at this time. By hearing this click, the user can confirm that the ink cartridge 1 has been properly fixed to the cartridge mounting part 101.

Here, the depth of the groove in the fixing part 18 of the guide groove 16 is set larger than the length of the fixing pin 112 similarly to that in the flat part 19*c*, of the entrance-side guide part 19. Further, by the elastic deformation of the turn lever member 108 produced when the fixing pin 112 passes through the entrance slant surface 22, the fixing pin 112 is urged toward the bottom surface of the guide groove 16.

Therefore, regarding the fixing pin 112 fixed in the predetermined fixing position of the stopping part 18, its full length enters into the inside of the guide groove 16, and the peripheral edge part of the top surface of the pin attaching part 111 fits against the edge part of the guide groove 16. Hereby, this fitting against the side wall of the guide groove 16 can serve to prevent the fixing pin 112 (particularly, its base part) from experiencing creep resulting from the force applied to the fixing pin 112. Namely, in case that the fixing pin 112 is caught in the guide groove 16 shallowly, the force applied to the base part of the fixing pin 112 increases by the principle of levers. However, in the embodiment, since the fixing pin 112 is caught in the guide groove 16 throughout its full length as described above, the creep of the fixing pin 112 can be prevented.

Further, since the fixing pin 112 is caught in the guide groove 16 deeply enough, the fixing pin 112 never comes out of the guide groove 16. This effect is not limited to only the fixing part 18 but is obtained also while the fixing pin 112 is relatively moving in the guide groove 16 in case that the peripheral edge part of the top surface of the pin attaching part 111 slides the edge part of the guide groove 16.

Further, the fixing pin 112 is urged toward one side surface of the ink cartridge 1 by the spring member 109, and the electrode 8*a*, of the memory unit 8 is provided on this side surface. Therefore, the urging force of the spring member 109 acts through the fixing pin 112 and the lastly stopping side wall part 18*a*, so that the electrode 8 of the memory unit 8 is pressed toward the apparatus-side contact 113 (FIGS. 9 and 10) Hereby, it is possible to secure the connections between the electrode 8*a*, of the memory unit 8 and the apparatus-side contact 113.

Next, when the ink cartridge 1 is removed from the cartridge mounting part 101, the ink cartridge 1 is pushed slightly in the inserting direction X by the user. Then, engagement of the fixing pin 112 with the lastly stopping side wall 18*a*, is released, and the fixing pin 112 moves in the direction Z in response to the urging force exerted by the spring member 109. Next, the fixing pin 112 collides with the curved side wall 21*a*, of the exit-side guide part 21 of the guide groove 16 and temporarily stops (position H in FIG. 17). At this time, an audible click is produced. By hearing the click, the user can confirm that fixing of the ink cartridge 1 to the cartridge mounting part 101 has been released.

Next, the user stops pressing the ink cartridge 1 in the inserting direction X. When the ink cartridge 1 moves in the pulling direction Y in response to the urging force of the slide member 102, the fixing pin 112 moves along the linear slant surface 21*b*, of the exit-side guide part 21 (position I in FIG. 17). At this time, the leading end of the fixing pin 112 comes into contact with the slant surface 21*b*, in the middle of the slant surface 21*b*, and the fixing pin 112 moves upward in the opposite direction to the groove depth direction. The fixing pin 112 that has passed through the slant surface 21*b*, passes through the flat part 21*c*, (position J in FIG. 17) and out from the exit part 16*b*, of the guide groove 16.

Next, a connection process of the ink cartridge 1 to the ink supply needle 106, etc. when the ink cartridge 1 is mounted to the cartridge mounting part 101 will be described.

When the ink cartridge 1 is inserted into the cartridge mounting part 101, firstly, the positioning projections 103*a*, 103*b*, of the slider member 102 are inserted into the positioning holes 5*a*, 5*b*, of the ink cartridge 1. Further, the pressure fluid port 105 of the slider member 102 is connected to the pressure fluid inlet 4 of the ink cartridge 1. Further, the electrode 8*a*, of the memory unit 8 and the apparatus-side contact 113 are connected to each other, whereby electrical communication can be established.

The electrode 8*a*, of the memory unit 8 and the apparatus-side contact 113 establish electrical communication before the ink supply needle 106 has been inserted into the ink supply port 3 of the ink cartridge. Accordingly, the data is read from the memory unit 8 at this time, and a determination is made whether the proper ink cartridge 1 has been inserted. If the wrong ink cartridge 1 has been inserted, then before the ink supply needle 106 is inserted into the ink supply port 3 of the wrong ink cartridge 1, there is an opportunity to replace the wrong ink cartridge with the proper ink cartridge. Hereby, it is possible to prevent the wrong type of ink from flowing into the ink flowing path of the apparatus body. Further, in this situation, when the ink supply port 3 of the ink cartridge 1 that has been inserted wrongly is sealed by a seal, it is possible to avoid breaking the seal unnecessarily.

After the ink cartridge 1 has been connected to the slider member 102, the ink cartridge 1 is further pushed in the inserting direction X against the urging force of the slider member 102, whereby the ink supply needle 106 is inserted into the ink supply port 3 of the ink cartridge 1. At this time, the container-side abutment portion 4A of the ink cartridge 1 is pressed elastically by the top surface 105A of the pressure fluid port 105 constituting the apparatus-side abutment portion, and by this pressing force, the electrode 8*a*, of the memory unit 8 is pressed toward the apparatus-side contact 113.

When the user stops pressing of the ink cartridge 1 into the cartridge mounting part 101, the ink cartridge 1 is pushed backward slightly and the fixing pin 112 is engaged with the fixing part 18 of the guide groove 16, whereby the ink cartridge 1 is held at a predetermined mounting position. In this condition, the pressing force is still present so that the container-side abutment portion 4A of the ink cartridge 1 is pressed by the top surface 105A of the pressure fluid port 105, and therefore the electrode 8*a*, of the memory unit 8 is pressed toward the apparatus-side contact 113.

Next, a separation process for disengaging the ink cartridge 1 from the ink supply needle 106 when the ink cartridge 1 is detached from the cartridge mounting part 101 will be described.

As described above, by pushing the ink cartridge 1 inward in the inserting direction X, fixing of the ink cartridge 1 by the cartridge-side fixing structure 7 and the apparatus-side fixing structure 107 is released, and the ink cartridge 1 can move in the pulling direction Y. The ink cartridge, released and no long fixed in position, moves firstly in the pulling direction Y together with the slider member 102, and the ink supply needle 106 comes out from the ink supply port 3 as a result of this movement.

When the ink supply needle 106 thus comes out from the ink supply port 3, since the connection between the electrode 8*a*of the memory unit 8 and the apparatus-side contact 113 is still maintained, data can be exchanged between the memory unit 8 and the apparatus body. Even though the ink cartridge has been released, data can be exchanged between the memory unit 8 of the cartridge 1 and the apparatus body, so that data transmission errors can be prevented.

When the ink cartridge is further moved in the pulling direction Y, the slider member 102 reach a position in the predetermined position at which it becomes unmovable. When the ink cartridge 1 is further moved in the pulling direction Y from this state, the pressure fluid port 105 is separated from the pressure fluid inlet 4 of the ink cartridge 1, and the positioning projections 103*a*, 103*b*, come out of the positioning holes 5*a*, 5*b*, of the ink cartridge 1. Further, the electrode 8 of the memory unit 8 and the apparatus-side contact 113 are disconnected.

As described above, the ink cartridge 1 according to the embodiment can be mounted to the cartridge mounting part 101 of the ink jet type recording apparatus 100 readily and surely.

Particularly, in the ink cartridge 1 according to the embodiment, since the width of the entrance slant surface 22 formed at the entrance part 16*a*, of the guide groove 16 can be made large, the insertion of the fixing pin 112 into the guide groove 16 can be surely performed. Since the turn lever member 108 including the fixing pin 112 is constructed so as to swing in the direction Z perpendicular to the inserting and pulling directions X, Y of the ink cartridge 1, variations may be produced in the initial position (the position in a state where the ink cartridge has not been mounted yet) of the fixing pin 112. However, by making the width of the entrance slant surface 22 large, these variations can be accommodated.

Further, in the ink cartridge 1 according to the embodiment, it is possible to complete the mounting operation by only one operation (single push operation) that the ink cartridge 1 is inserted into the cartridge mounting part 101. On the other hand, when the ink cartridge 1 is removed from the cartridge mounting part 101, the fixing state of the ink cartridge 1 can be released by only the easy operation that the ink cartridge 1 is slightly pushed in. In the embodiment, it is possible to perform the mounting and removal operations of the ink cartridge 1 very readily like this.

Further, in the ink cartridge 1 according to this embodiment, since the guide groove 16 is formed on the bottom surface of the recess part 17 formed on the surface of the cartridge, in the state where the fixing pin 112 is inserted into the guide groove 16, the protruding amount of the turn lever member 108 from the cartridge surface can be reduced or even made zero. Therefore, the thickness of the cartridge mounting part 101 can be reduced, so that the size of the ink jet type recording apparatus 100 can be decreased. Particularly, in the case of an apparatus of the type in which the plural ink cartridges 1 are arranged in a flat and juxtaposed manner such as the ink jet type recording apparatus 100 shown in FIG. 1, it is desirable to reduce the thickness of the whole of the apparatus. Therefore, the ink cartridge 1 according to the embodiment, which can reduce the thickness of the cartridge mounting part 101, is very effective and helpful to achieving this goal.

Further, in the ink cartridge 1 according to the embodiment, since the memory unit 8 including the electrode 8*a*, is arranged near the cartridge-side fixing structure 7, the electrode 8*a*of the memory unit 8 can be surely and securely connected to the apparatus-side contact 113 of the cartridge mounting part 101.

Particularly, since the urging force of the spring member 109 acts so as to press the electrode 8*a*, of the memory unit 8 in the direction of the apparatus-side contact 113 of the cartridge mounting part 101 through the fixing pin 112 and the lastly stopping side wall 18*a*, the electrode 8 of the memory unit 8 can be surely connected to the apparatus-side contact 113.

Further, since the cartridge-side fixing structure 7 and the memory unit 8 including the electrode 8*a*, are arranged at a position near the ink supply port 3 of the whole of the container body 2, the connection of the electrode 8 of the memory unit 8 to the apparatus-side contact 113 can be more surely performed.

Further, the memory unit 8, including the electrode 8*a*, is arranged near the cartridge-side fixing structure 7, and the positioning hole 5*a*, and the cartridge-side positioning surface 24*a*, that are used for accurate positioning. Therefore, the connection of the electrode 8 of the memory unit 8 to the apparatus-side contact 113 can be more surely performed.

In the ink cartridge 1 according to this embodiment, the ink supply port 3, the electrode 8*a*, of the memory unit 8, the container-side abutment portion 4A, the positioning hole 5*a*, and the cartridge-side fixing structure 7 have such a positional relationship that the pressing force applied to the container-side abutment portion 4A from the top surface 105A of the pressure fluid port 105 presses the electrode 8*a*, of the memory unit 8 toward the apparatus-side contact 113 when the ink cartridge 1 is mounted onto the cartridge mounting part 101. Therefore, the ink cartridge 1 is mounted onto the cartridge mounting part 101, it is possible to surely connect the electrode 8*a*, of the memory unit 8 of the ink cartridge 1 to the apparatus-side contact 113 of the ink jet recording apparatus 100, and to surely maintain the connection therebetween.

Further, in the ink cartridge 1 according to this embodiment, since the memory unit 8 is disposed on the side surface of the container body 2, the ink cartridge 1 can be made small in size easily.

What is claimed is:

1. A liquid container that stores therein liquid to be supplied to a liquid consuming apparatus, and which is adapted to be removably mounted onto a container mounting part of the liquid consuming apparatus, the liquid container comprising:

a container body formed with a liquid supply port through which the liquid to be supplied to the liquid consuming apparatus flows outward; and a container-side fixing structure which releasably regulates movement of the liquid container in an outward pulling direction in cooperation with an apparatus-side fixing structure provided for the container mounting part in a state where the liquid container is mounted onto the container mounting part, the container-side fixing structure including;

a guide groove adapted to receive a fixing pin of the apparatus-side fixing structure, and which guides the fixing pin in mounting and removal operations of the liquid container to and from the container mounting part; and the guide groove including a fixing part which engages the fixing pin to regulate the movement of the liquid container in the pulling direction in the state where the liquid container is mounted to the container mounting part, the guide groove having an entrance-side guide path leading the fixing pin from an entrance part to the fixing part, and an exit-side guide path distinct from the entrance-side guide path and leading the fixing pin from the fixing part to an exit part;

wherein the guide groove is formed at a bottom surface of a recess part formed on a surface of the container body.

2. The liquid container according to claim 1, wherein the guide groove includes an entrance-side guide part which leads the fixing pin when the liquid container is inserted into the container mounting part; an intermediate guide part which leads the fixing pin to the fixing part when the liquid container that has been inserted into the container mounting part is shifted backward in the pulling direction; and an exit-side guide part which guides, to an exit part of the guide groove, the fixing pin that has been released from the fixing part by pushing the liquid container in the inserting direction when the liquid container is removed from the container mounting part.

3. The liquid container according to claim 2, wherein:

the entrance-side guide part includes an entrance part configured to first receive the fixing pin when the liquid container is inserted into the container mounting part, and a linear portion configured to guide the fixing pin from the entrance part to the intermediate guide part when the liquid container is inserted into the container mounting part; and a width of the entrance part is larger than a width of the linear portion.

4. The liquid container according to claim 3, wherein an entrance slant surface is formed at the entrance part.

5. The liquid container according to claim 4, wherein:

the entrance-side guide part further includes a flat part continued from the entrance slant surface; and a groove depth of the flat part is smaller than a length of the fixing pin.

6. The liquid container according to claim 1, wherein the guide groove has a first stopping side wall part which stops movement of the fixing pin that moves in the direction of the fixing part when the liquid container has been inserted into the container mounting part to a predetermined depth, such movement being stopped in front of the fixing part; and the fixing part of the guide groove has a, second stopping side wall part which stops at a predetermined position the fixing pin that is released from the first stopping side wall part and moves to the fixing part when the liquid container that has been inserted into the container mounting part to the predetermined depth is pushed back in the pulling direction.

7. The liquid container according to claim 1, wherein the exit part of the guide groove is connected to the entrance part, and a groove depth of the exit part is shallower than a groove depth of the entrance part in its connection part, whereby a step part is formed at the connection part for guiding the fixing pin when the liquid container is inserted into the container mounting part.

8. The liquid container according to claim 1, wherein at least a part of the portion from the entrance part of the guide groove to the fixing part extends at an angle of 30° to 50° relative to the inserting/pulling direction of the liquid container.

9. The liquid container according to claim 1, wherein the guide groove has a rectangular section.

10. The liquid container according to claim 1, wherein the liquid consuming apparatus is an ink jet type recording apparatus, and the liquid container is an ink cartridge that is removably mountable to the ink jet type recording apparatus.

11. The liquid container according to claim 1, further comprising:

a plurality of electrodes, each said electrode having a contact portion, the contact portions being disposed in a plane, wherein the bottom surface and the plane are perpendicular.

12. A liquid container that stores therein liquid to be supplied to a liquid consuming apparatus, and which is adapted to be removably mounted onto a container mounting part of the liquid consuming apparatus, the liquid container comprising:

a container body formed with a liquid supply port through which the liquid to be supplied to the liquid consuming apparatus flows outward; and a container-side fixing structure which releasably regulates movement of the liquid container in an outward pulling direction in cooperation with an apparatus-side fixing structure provided for the container mounting part in a state where the liquid container is mounted onto the container mounting part, the container-side fixing structure including;

a guide grooved adapted to receive a fixing pin of the apparatus-side fixing structure, and which guides the fixing pin in mounting and removal operations of the liquid container to and from the container mounting part;

the guide groove including a fixing part which engages the fixing pin to regulate the movement of the liquid container in the pulling direction in the state where the liquid container is mounted to the container mounting part, the guide groove having an entrance-side guide path leading the fixing pin from an entrance part to the fixing part, and an exit-side guide path distinct from the entrance-side guide path and leading the fixing pin from the fixing part to an exit part; and an electrode disposed on the container body, wherein the fixing part of the guide groove has a side wall part which catches the fixing pin that is urged toward the electrode in the state where the liquid container is mounted to the container mounting part.

13. The liquid container according to claim 12, wherein the guide groove includes an entrance-side guide part which leads the fixing pin when the liquid container is inserted into the container mounting part; an intermediate guide part which leads the fixing pin to the fixing part when the liquid container that has been inserted into the container mounting part is shifted backward in the pulling direction; and an exit-side guide part which guides, to an exit part of the guide groove, the fixing pin that has been released from the fixing part by pushing the liquid container in the inserting direction when the liquid container is removed from the container mounting part.

14. The, liquid container according to claim 12, wherein the guide groove has a first stopping side wall part which stops movement of the fixing pin that moves in the direction of the fixing part when the liquid container has been inserted into the container mounting part to a predetermined depth, such movement being stopped in front of the fixing part; and the fixing part of the guide groove has a second stopping side wall part which stops at a predetermined position the fixing pin that is released from the first stopping side wall part and moves to the fixing part when the liquid container that has been inserted into the container mounting part to the predetermined depth is pushed back in the pulling direction.

15. The liquid container according to claim 12, wherein the exit part of the guide groove is connected to the entrance part, and a groove depth of the exit part is shallower than a groove depth of the entrance part in its connection part, whereby a step part is formed at the connection part for guiding the fixing pin when the liquid container is inserted into the container mounting part.

16. The liquid container according to claim 12, wherein at least a part of the portion from the entrance part of the guide groove to the fixing part extends at an angle of 30° to 50° relative to the inserting/pulling direction of the liquid container.

17. The liquid container according to claim 12, wherein the guide groove has a rectangular section.

18. The liquid container according to claim 12, wherein the liquid consuming apparatus is an ink jet type recording apparatus, and the liquid container is an ink cartridge that is removably mountable to the ink jet type recording apparatus.

19. The liquid container according to claim 12, wherein the guide groove is formed in first face of the container body and the electrode is disposed on a second face of the container body that is perpendicular to the first face.

* * * * *